US010837149B2

(12) United States Patent
Klein

(10) Patent No.: US 10,837,149 B2
(45) Date of Patent: Nov. 17, 2020

(54) ERECTABLE BARRIER

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 0 days.

(21) Appl. No.: 16/344,461

(22) PCT Filed: Oct. 25, 2017

(86) PCT No.: PCT/IL2017/051165
§ 371 (c)(1),
(2) Date: Apr. 24, 2019

(87) PCT Pub. No.: WO2018/078621
PCT Pub. Date: May 3, 2018

(65) Prior Publication Data
US 2019/0323187 A1 Oct. 24, 2019

Related U.S. Application Data

(60) Provisional application No. 62/412,317, filed on Oct. 25, 2016, provisional application No. 62/460,916, filed on Feb. 20, 2017.

(51) Int. Cl.
*E01F 13/00* (2006.01)
*E01F 13/12* (2006.01)

(52) U.S. Cl.
CPC ..... *E01F 13/123* (2013.01)

(58) Field of Classification Search
CPC ..... E01F 13/12; E01F 13/123
USPC ..... 404/6; 256/13.1
See application file for complete search history.

(56) References Cited

U.S. PATENT DOCUMENTS

| | | | | | |
|---|---|---|---|---|---|
| 2,961,786 | A * | 11/1960 | Lowmaster | G09F 15/0062 | 40/606.14 |
| 4,279,105 | A * | 7/1981 | Cameron | E04H 1/12 | 116/63 T |
| 4,354,771 | A * | 10/1982 | Dickinson | E01F 13/08 | 404/6 |
| 4,367,975 | A * | 1/1983 | Tyers | E01F 13/04 | 404/11 |
| 4,998,843 | A | 3/1991 | Mothe | | |
| 6,702,512 | B1 * | 3/2004 | Reale | E01F 13/123 | 404/6 |
| 7,025,526 | B2 * | 4/2006 | Blair | E01F 13/105 | 404/6 |
| 8,256,985 | B2 * | 9/2012 | Ashmead | E01F 13/02 | 404/6 |
| 10,266,999 | B2 * | 4/2019 | Rothschild | E01F 13/12 | |
| 2019/0161927 | A1 * | 5/2019 | Pan | G05D 1/0011 | |

FOREIGN PATENT DOCUMENTS

| | | | |
|---|---|---|---|
| DE | 10108586 | A1 | 9/2002 |
| GB | 2261006 | B | 5/1993 |
| WO | 2007105940 | A1 | 9/2007 |

* cited by examiner

*Primary Examiner* — Raymond W Addie
(74) *Attorney, Agent, or Firm* — William Dippert; Laurence Greenberg; Werner Stemer

(57) ABSTRACT

An erectable barrier unit as well as a barricade made of a plurality of units are disclosed. The erectable barrier unit comprises a base and at least one movable hurdle connected to the base wherein the movable hurdle can instantly erect from a resting position in which the hurdle is adjacent to the base to an erected position in which a predetermined angle is formed between the hurdle and the base.

22 Claims, 16 Drawing Sheets

ERECTABLE BARRIER

CROSS-REFERENCE TO RELATED APPLICATIONS

The present application is a National Phase filing under 35 U.S.C. § 371 of International Patent Application No. PCT/IL2017/051165, filed Oct. 25, 2017, which is based upon and claims the benefit of the priority dates of U.S. Provisional Patent Application Ser. No. 62/412,317, filed Oct. 25, 2016 and U.S. Provisional Patent Application Ser. No. 62/460,916, filed Feb. 20, 2017, each of which is expressly incorporated herein by reference in its entirety.

TECHNICAL FIELD

The present disclosed subject matter relates to road barriers. More particularly, the present disclosed subject matter relates to erectable barriers to be erected upon need.

BACKGROUND

Road barriers are used to block roads for the purpose of hostile vehicle mitigation as well as controlling vehicular transportation. Control over roads is a security measure that is essential especially in the last decades. It is a necessity to have better control over roads using erectable barriers that can be applied upon need.

Unless otherwise defined, all technical and scientific terms used herein have the same meaning as commonly understood by one of ordinary skill in the art to which this disclosed subject matter belongs. Although methods and materials similar or equivalent to those described herein can be used in the practice or testing of the present disclosed subject matter, suitable methods and materials are described below. In case of conflict, the specification, including definitions, will control. In addition, the materials, methods, and examples are illustrative only and not intended to be limiting.

SUMMARY

It is provided in accordance with disclosed subject matter an erectable barrier unit comprising:

a base;

at least one movable hurdle connected to the base wherein the movable hurdle can instantly erect from a resting position in which the hurdle is adjacent to the base to an erected position in which a predetermined angle is formed between the hurdle and the base.

Furthermore and in accordance with another embodiment, the erected position is a default position.

Furthermore and in accordance with another embodiment, the erectable barrier unit is further provided with a default mechanism between the hurdle and the base, and wherein the default mechanism comprises a spring and a corresponding axis that assures the hurdle is in an upright position relative to the base.

Furthermore and in accordance with another embodiment, a fastener is provided between the hurdle and the base so as to assure they are fully adjacent in the resting position.

Furthermore and in accordance with another embodiment, the base is provided at at least one of its ends with an extension and wherein the extension is shaped as a wedge.

Furthermore and in accordance with another embodiment, a free end of the hurdle is wedge shaped.

Furthermore and in accordance with another embodiment, in the resting position, the barrier unit is flat.

Furthermore and in accordance with another embodiment, the movable hurdle is hingeably connected to the base and can rotate about the hinge relative to the base.

Furthermore and in accordance with another embodiment, the predetermined angle is more than 90 degrees.

Furthermore and in accordance with another embodiment, the predetermined angle is between 30 and 60 degrees.

Furthermore and in accordance with another embodiment, a band is connected between the hurdle and the base.

Furthermore and in accordance with another embodiment, the base is provided with holes through which it can be fixed to a road.

Furthermore and in accordance with another embodiment, a lower portion of the base is provided with grippers configured to prevent free movement of the erectable barrier unit onto a surface.

Furthermore and in accordance with another embodiment, the at least one hurdle and the base are provided with connecting protrusions that are configures to receive connecting rods that can connect a plurality of similar barrier units having a plurality of bases and movable hurdles aligned to each other so as to form a barricade.

Furthermore and in accordance with another embodiment, the plurality of bases is embedded within a designated structure shaped as a speed bump.

Furthermore and in accordance with another embodiment, the at least one movable hurdle comprises at least two supporting rods that are moving one towards the other and wherein the at least two supporting rods are connected by a hinge positioned between them so that as the rods are moving towards each other, the hinge is getting distantly from the base.

Furthermore and in accordance with another embodiment, at least two plates are connected onto the supporting rods so that in the erecting position, the plates are opposite each other in an upright position so as to form a bidirectional barrier.

Furthermore and in accordance with another embodiment, the erectable barrier unit further comprises fastening shafts connected between the base and the supporting rods wherein when the plates are erected, the supporting rods and the fastening shafts form a rhombus structure that provides additional strength to the barrier.

Furthermore and in accordance with another embodiment, the base comprises two parallel beams onto which the supporting rods can slide.

Furthermore and in accordance with another embodiment, the parallel beams are provided with sweepers configured to sweep the base.

Furthermore and in accordance with another embodiment, the at least one movable hurdle are two hurdles, each of the two hurdles erects to an opposite direction.

Furthermore and in accordance with another embodiment, the predetermined angle between each of the two hurdles and the base is between 30-60 degrees.

Furthermore and in accordance with another embodiment, the at least two hurdles and the base have corresponding holes through which a hinge can be inserted in order to attach the hurdle and the base together.

Furthermore and in accordance with another embodiment, the two hurdles have a free end having a slope.

Furthermore and in accordance with another embodiment, the two hurdles are recessed within the base when in resting position.

Furthermore and in accordance with another embodiment, the base is provided with a slope at its end and wherein the slope of the base corresponds the slope of the hurdle, when in resting position.

Furthermore and in accordance with another embodiment, each of the two hurdles comprises a cutout directed to the base, wherein the cutout is configured to clear corresponding hinges when in resting position.

Furthermore and in accordance with another embodiment, the erectable barrier unit is configured to block vehicles in a bidirectional manner.

It is furthermore provided a barricade comprising a plurality of erectable barrier units as claimed in Claims 1-28, wherein the base of the barrier units are aligned and connected one to the other.

BRIEF DESCRIPTION OF THE DRAWINGS

Some embodiments of the disclosed subject matter described, by way of example only, with reference to the accompanying drawings. With specific reference now to the drawings in detail, it is stressed that the particulars shown are by way of example and for purposes of illustrative discussion of the preferred embodiments of the present disclosed subject matter only, and are presented in the cause of providing what is believed to be the most useful and readily understood description of the principles and conceptual aspects of the disclosed subject matter. In this regard, no attempt is made to show structural details of the disclosed subject matter in more detail than is necessary for a fundamental understanding of the disclosed subject matter, the description taken with the drawings making apparent to those skilled in the art how the several forms of the disclosed subject matter may be embodied in practice.

In the drawings.

DETAILED DESCRIPTION

Figure 1A:
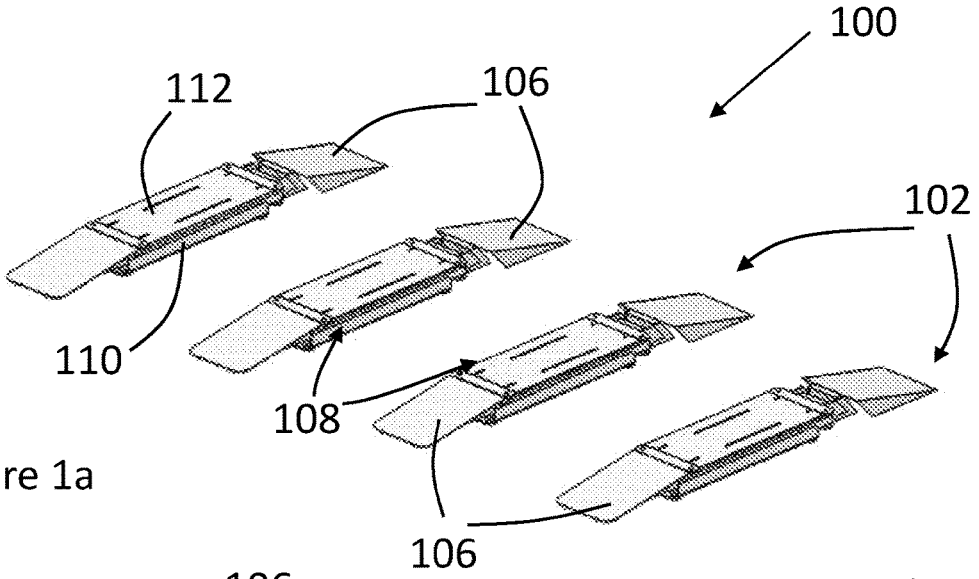
FIGS. 1*a-c* illustrate a unidirectional erectable barrier in a resting position in several views, in accordance with some exemplary embodiments of the disclosed subject matter.

Before explaining at least one embodiment of the disclosed subject matter in detail, it is to be understood that the disclosed subject matter is not limited in its application to the details of construction and the arrangement of the components set forth in the following description or illustrated in the drawings. The disclosed subject matter is capable of other embodiments or of being practiced or carried out in various ways. Also, it is to be understood that the phraseology and terminology employed herein is for the purpose of description and should not be regarded as limiting. The drawings are generally not to scale. For clarity, non-essential elements were omitted from some of the drawings.

The barriers depicted in the present application are designed to be placed at least for a certain period of time on the road with no disturbance to the vehicles passing by. However, the disclosed erectable barriers can be placed on sand or any other type of ground surface and even under water. The barriers may block the path for vehicles as well as animals, people or even airplanes from continuing to move in a certain direction. The barriers are configured to erect from the ground upon demand, while activating the barriers to a blockage position is actuated in the site or using a remote mechanism. The barriers are easily retained to their resting position when use is not needed. The barriers depicted in the application are aimed at immediate erection when blockage is needed and easy and immediate retaining of the resting position.

Moreover, the barriers depicted in the subject matter of the present application can be unidirectional or bidirectional, while in some preferred embodiments, the directionality of the barrier can be changed according to the specific needs in the site.

It is therefore provided, in accordance with preferred embodiments of the disclosed subject matter a barrier having two positions: a first position in which the barrier is flat and placed on the road while vehicles are able to pass onto it with minimal disturbance, if at all, and a second position in which the barrier is erected in a way that prevents vehicles from passing. The transition from the first position to the second position and vice versa is of an immediate nature wherein optionally the transition of the barrier from the first position to the second one can be remotely operated with no need for a person to attend the site.

Figure 1B:
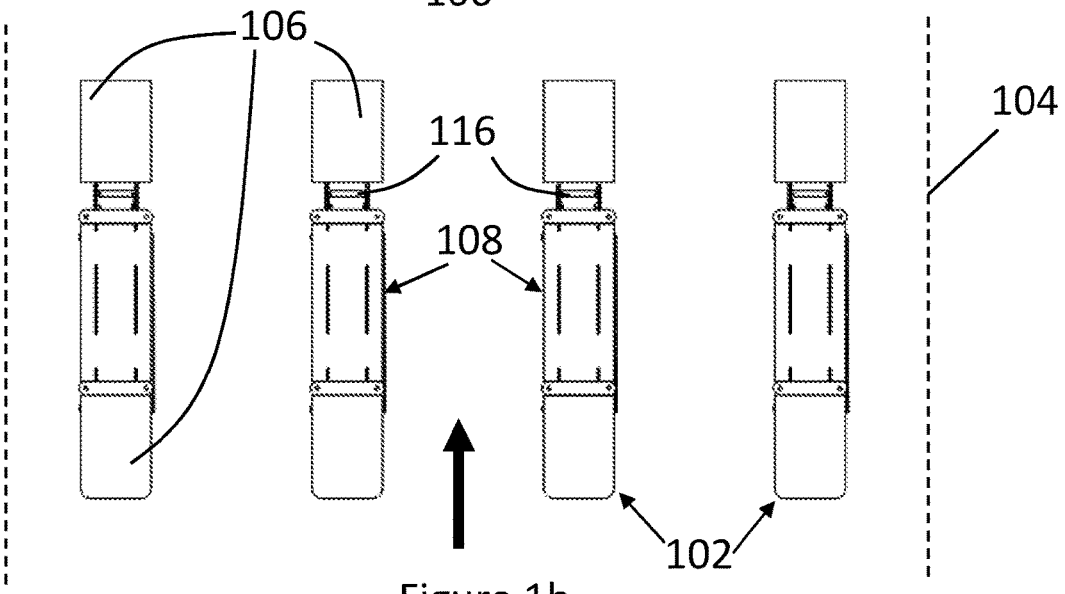
Figure 1C:
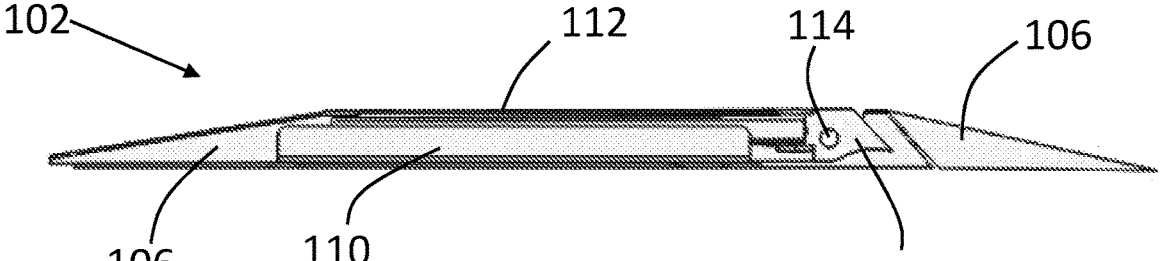

Reference is now made to FIGS. 1*a-c* illustrating a unidirectional erectable barrier in a resting position in several views, in accordance with some exemplary embodiments of the disclosed subject matter. The unidirectional erectable barrier 100 is made of several barrier units 102 that are placed one beside the other across a road. In FIG. 1*b*, the dotted lines 104 represent the shoulders of the road and the barrier units are arranged opposite the traffic direction. The barrier units 102 are designed in a flat configuration on the road so that vehicles can pass through the road on top of the barriers that are at rest and not used to control the traffic. Both sides of each unit is provided with a wedge-shaped extension 106 so that wheels of a vehicle can pass through the resting barrier 100 without significant disturbance. The vehicle that pass through the resting barrier 100 in the direction of the arrow shown in FIG. 1*b*, ascends on the wedge-shaped extension 106, pass through the middle portion 108, and descends through the other side wedge-shaped extension 106 of the barrier unit 102. Generally, the barriers are made of materials such as steel, aluminum, metal, hard metal, or stainless steel, manufactured in a method of hot rolling, extrusion, laser cutting, a combination thereof, or the like.

The middle portion 108 of the barrier unit 102 comprises two segments—a lower segment that forms the base 110 (clearly seen in FIGS. 1*a* and 1*c*) that is adjacent to the road and an upper segment that is a movable hurdle 112 that is connected through a hinge 114 (seen in FIG. 1*c*) to the base 110. The movable hurdle 112 that is shown in FIGS. 1*a* through 1*c* in resting position and therefore rests on the base 110 is capable of rotating about hinge 114 and be positioned in a substantial vertical position (will be shown herein after). In order for the movable hurdle 112 to be moved from the resting position to the vertical position, a recess 116 is provided between the hurdle 112 and the adjacent wedge-shaped extension 106 so as to allow replacement of the rotating hurdle edge 118 (best seen in FIG. 1*c*).

Figure 2:
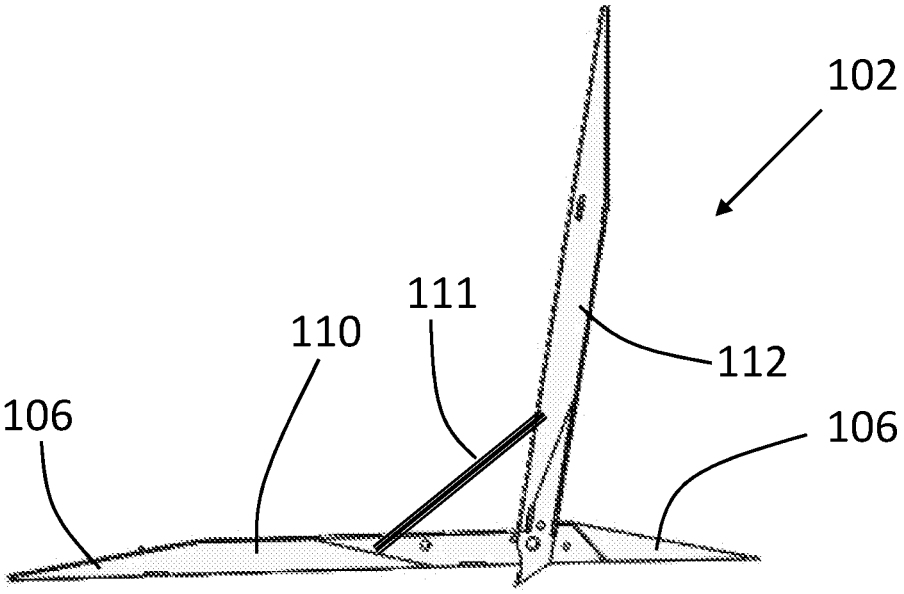
FIG. 2 illustrates the erectable barrier of FIGS. 1*a-c*, in an active upright position.

Reference is now made to FIG. 2 illustrating the erectable barrier of FIGS. 1*a-c*, in an active upright position. In this upright position, hostile vehicles may ascend the base portion 110, however, they will be stopped by the vertically upright hurdle 112.

The movable hurdle 112, when in an upright active position is arranged to be limited to slightly more than 90° angle between the hurdle and the base.

Optionally but preferably, a band is provided between the two parts of the barrier, the base portion 110 and the movable hurdle 112. The band 111 is connected between the two portions in order to avoid impact of a sudden release of the hurdle from the base upon opening the barrier to an active state.

It should be mentioned that the erectable barrier 100 can be placed on the road and be left on site for a predetermined period of time it is needed. Then, the barrier can be taken to another site. One of the advantages of the built up of the barrier from a plurality of units is that the units are independent of each other and therefore, some of them can be placed in an upright active position while the others are in resting position, an action that can facilitate control over the vehicles that pass by. The vehicles can still pass, however, using a relatively narrow passage that is left with resting barrier units.

Figure 3A:
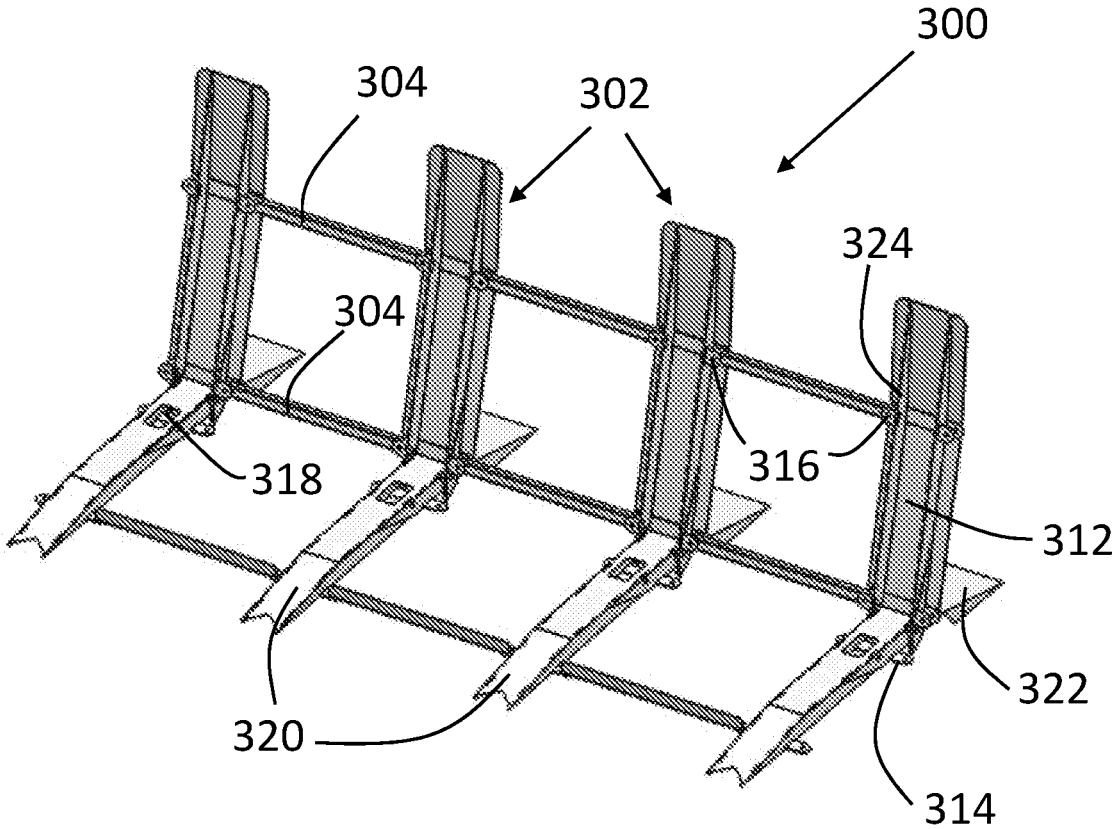
FIGS. 3*a-c* illustrate a unidirectional erectable barrier in an active upright position in several views, in accordance with some other exemplary embodiments of the disclosed subject matter.
Figure 3B:
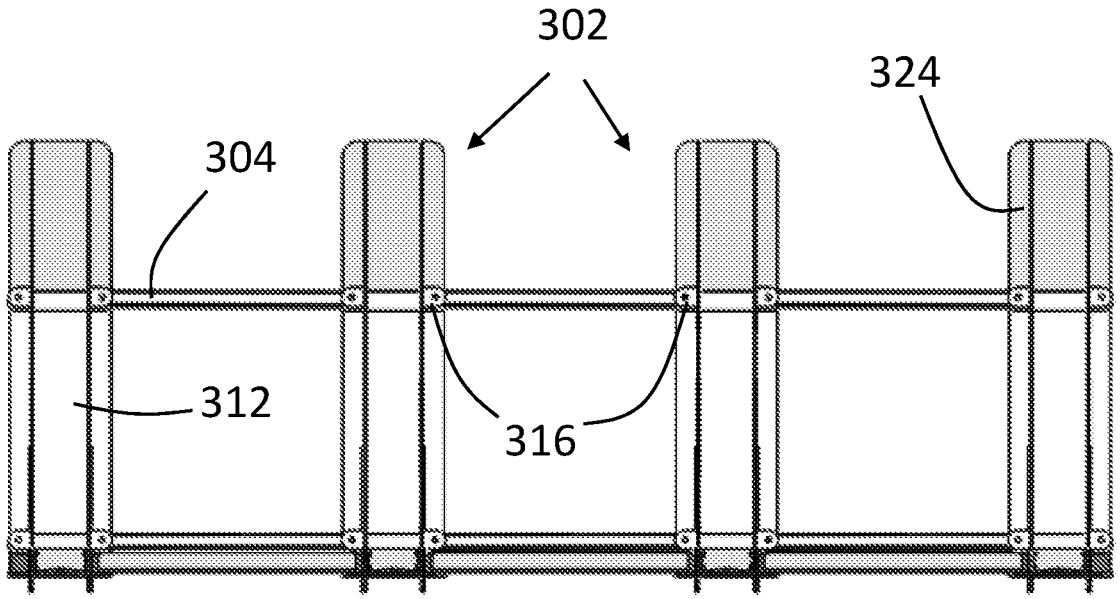
Figure 3C:
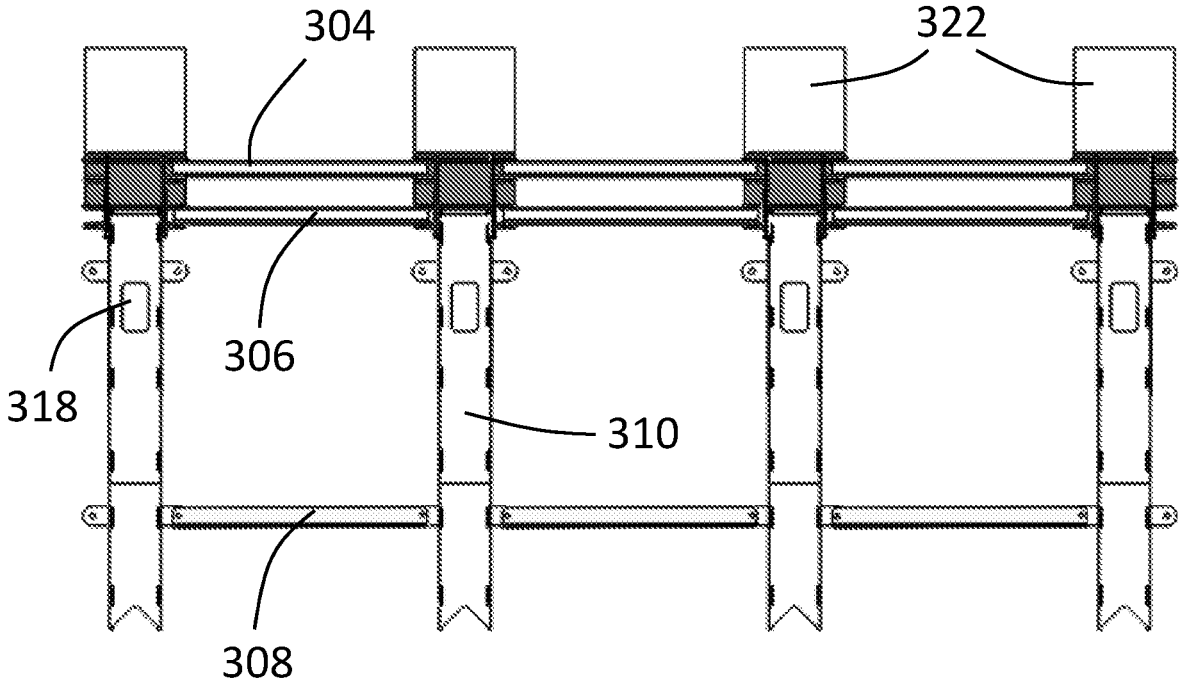

Reference is now made to FIGS. 3*a*-3*c* illustrating a unidirectional erectable barrier in an active upright position in several views, in accordance with some other exemplary embodiments of the disclosed subject matter. Erectable barrier 300 is made of a plurality of barrier units 302 similar to barrier units 102 shown in FIGS. 1*a-c*, however, the units 302 in this embodiment are connected to one another by at least one of an upper connecting rod 304, a bottom connecting rod 306, and/or a frontal connecting rod 308. Any other arrangement of connecting the units can be utilized without limiting the scope of the subject matter.

Similarly to the former embodiment, each barrier unit 302 is made of two segments—a lower base 310 (best seen in FIGS. 3*a* and 3*c*) and a movable hurdle 312 (best seen in FIGS. 3*a* and 3*b*). Due to the connection rods 304, all units have to be in an upright position together and there is no possibility to use some of the units in an independent manner. The connecting rods has corresponding connecting protrusions 314 on the base 310 or connecting protrusions 316 on the movable hurdle 312 so that the connecting rods are secured when the barrier is in use and when it is in storage.

It should be mentioned that the connecting rods can be rigid rods as shown herein, however, can be flexible as well, can be fully dismantle or not, a combination thereof, or the like.

Optionally, a recess 318 is provided on the upper edge of lower base 310 where a band (not shown in FIGS. 3*a-c*, but shown in FIG. 2) can be incorporated so that it will be held between the base and the hurdle. The band can optionally be flexible.

The lower base 310 of the barrier unit 302 is optionally wedge-shaped at the end 320 that faces the coming vehicles. On the other end, a wedge-shaped extension 322 is provided from similar reasons that were mentioned earlier in regard to the former embodiment and will be shown herein after. Optionally, the wedge-shaped extension 322 is connected to the lower base 310 by an axis so it has some freedom of movement that can partially absorb the stress that may be rendered to the barrier upon sudden opening of the hurdle.

Movable hurdle 312 is provided with enforcement elements 324 that are preferably welded along the hurdle to provide a strengthened profile.

Figure 4:
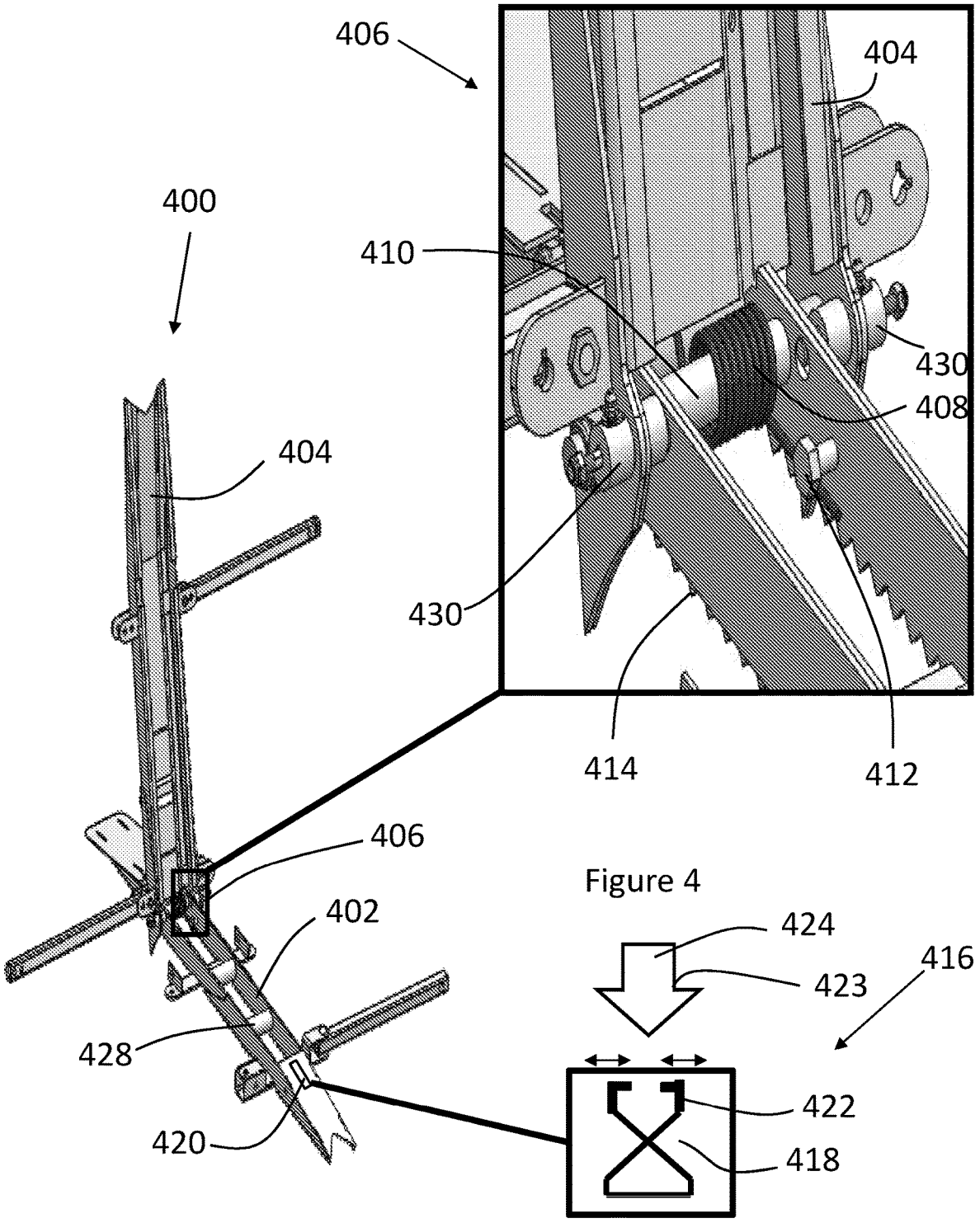
FIG. 4 illustrates a default mechanism between the base and the hurdle, in accordance with some other exemplary embodiments of the disclosed subject matter.

Reference is now made to FIG. 4 illustrating a default mechanism between the base and the hurdle, in accordance with some other exemplary embodiments of the disclosed subject matter. Barrier unit 400 is shown in an active position having a base 402 and a movable hurdle 404 in an upright position. Between those two components, a default mechanism 406 is provided by which the default position is when the hurdle is in an upright position.

The default mechanism 406 is shown in an enlargement figure. A spring 408 is held on an axis 410 that is positioned in a way that connects the lower base 402 to the movable hurdle 404. In the default state, in which the hurdle 404 is in an upright position, one end of the spring 408 is grasped by the hurdle 404 while the other end is stopped by a nut 412 in the base 402. In order to rotate the hurdle 404 and move it to the resting position in which it is mounted adjacently to the base 402, force against the spring has to be applied. Axis 410 is provided with two locking elements 430 from both sides of the axis so as to lock the opening position when the hurdle is in the upright position. One of the aims of the present disclosure is to provide a barrier that is operated immediately upon a request without having the need for a person to attend the site. The default mechanism can be remotely operated from a distant location using electronic means that can also be wireless. As the default mechanism is activated, the hurdles of the barrier are opened to block any passage of vehicles.

Optionally, a fastener is provided in order to maintain the hurdle 404 in the resting position. Upon release of the fastener, the hurdle will be forced by the spring 408 to the upright active position. An example of such possible fastener 416 built of two parts, is schematically shown in FIG. 4—a female part 418 (shown in an enlargement) that is placed within a recess 420 in the upper edge of the distant part of the base portion 402, wherein the female part 418 is provided with two moving plates 422 (the movement is indicated by arrows) adapted to get hold of a prong 424 through a recess 423 and release it, the prong is the male portion that is connected to the inner part of the hurdle. Prong 424 is connected to the moving hurdle 404 so that when the hurdle is resting onto the base, the prong 424 is held between the plates 422 of the female portion 418. Again, similar hookup between the hurdle and the base portion can be established when the two parts are at rest and upon release of this hookup, the hurdle is erected to an upright and active position in an immediate manner. It should be mentioned that any other mechanism can be applied in order to achieve the transition between those two positions—the active upright position and the resting position. Moreover, electronic, hydraulic, or pneumatic mechanism can be applied as well without limiting the scope of the presented subject matter.

Optionally, the activation by erection of the erectable barrier can be performed from a distance using a control mechanism that can be activated through a cell phone or another dedicated device.

Optionally, the bottom of the lower base 402 can be provided with grippers 414 adapted to grasp the surface of the road in order to prevent its movement when vehicles pass over it. Optionally and alternatively, the base portion can be provided with means to attach the barrier unit to the ground for cases the barrier is to be positioned in the site for a relatively long period of time.

Figure 5A:
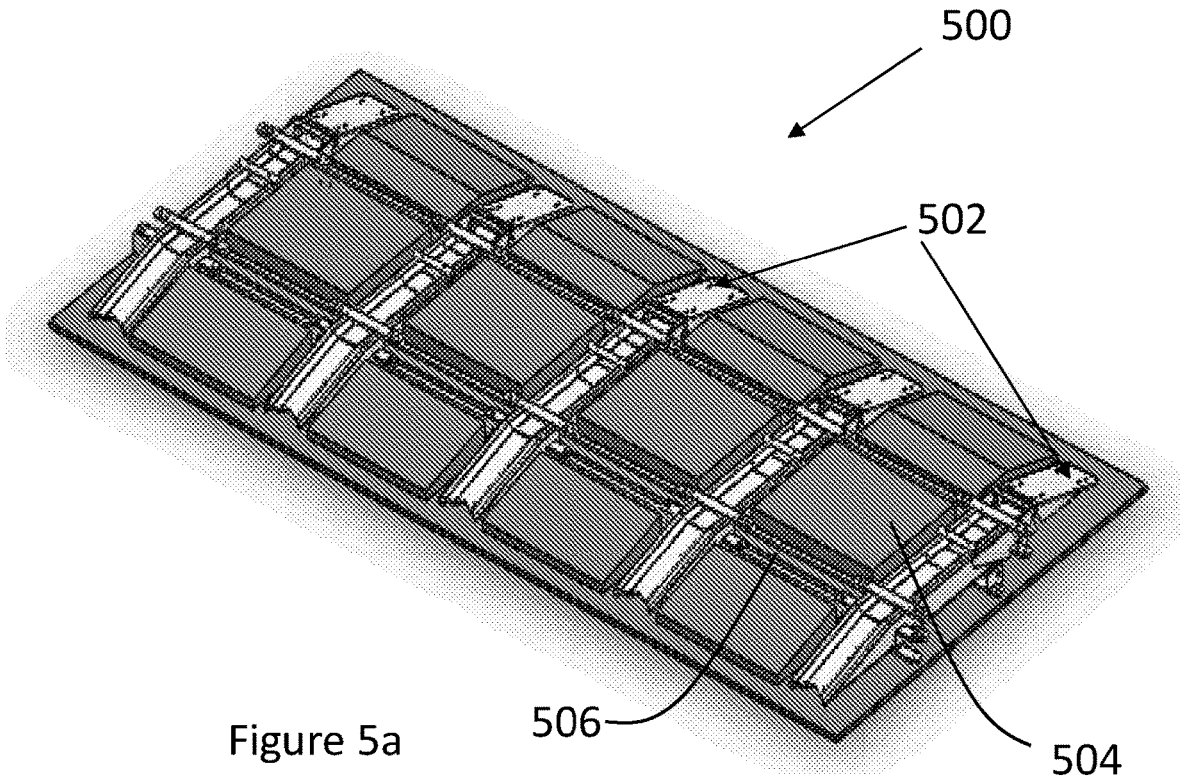
FIGS. 5*a-d* illustrate a unidirectional erectable barrier in two positions and in several views, in accordance with some exemplary embodiments of the disclosed subject matter.
Figure 5B:
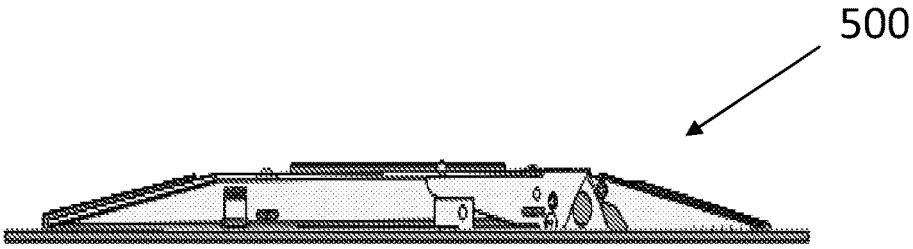
Figure 5C:
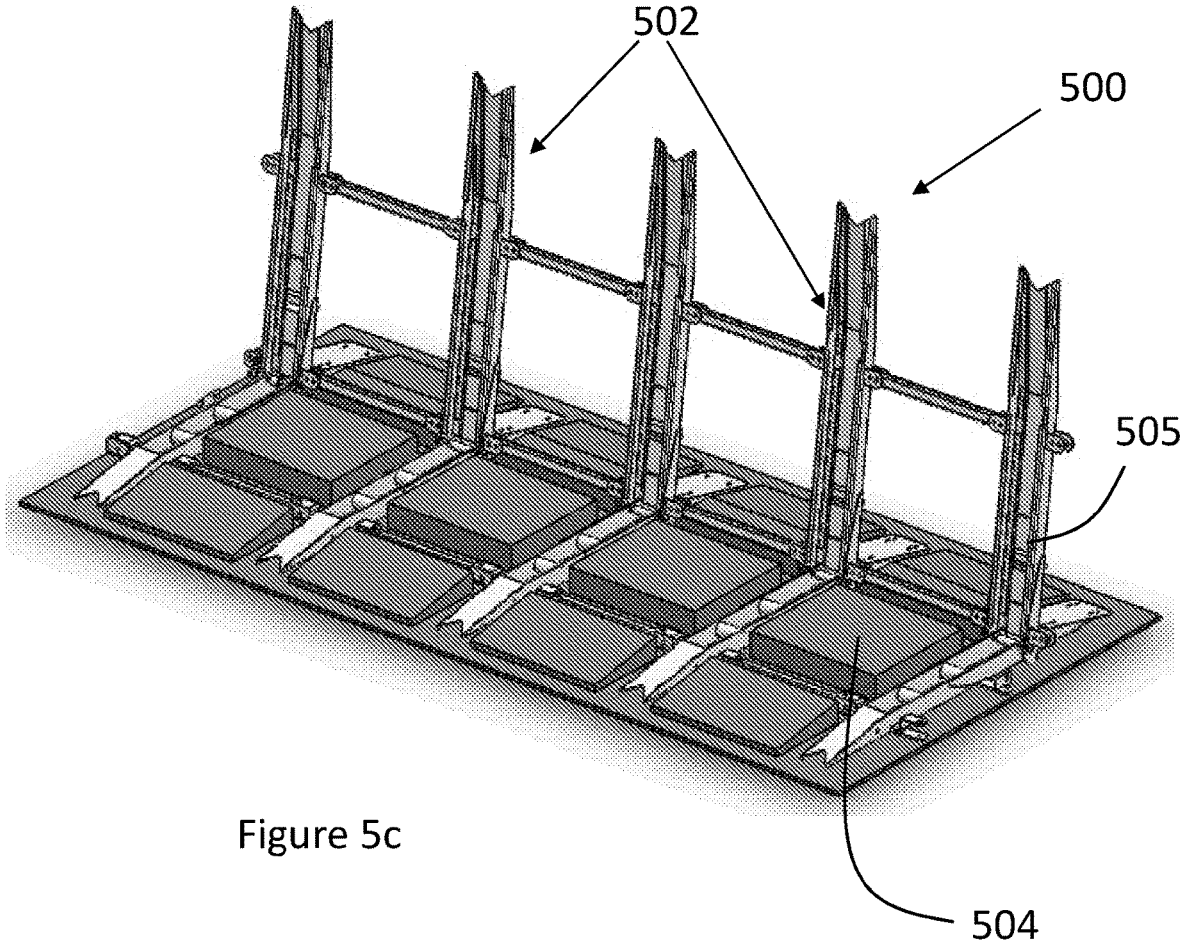
Figure 5D:
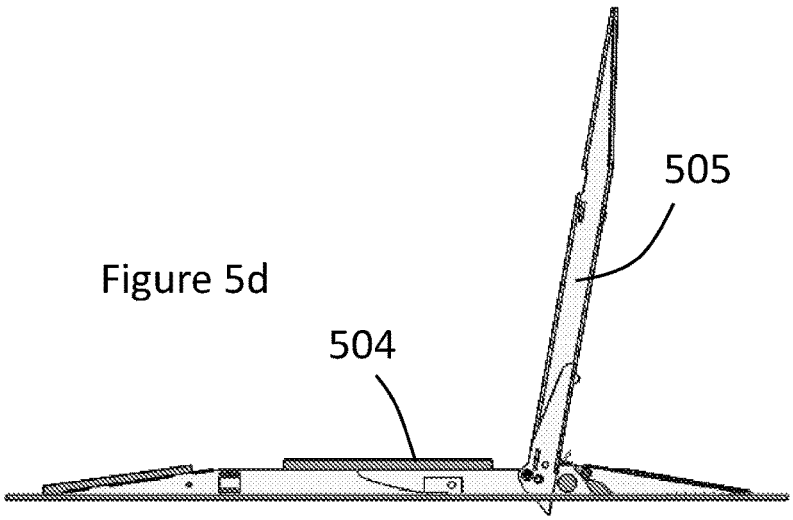

Reference is now made to FIGS. 5*a-d* illustrating a unidirectional erectable barrier in two positions and in several views, in accordance with some exemplary embodiments of the disclosed subject matter. Although the barrier is aimed to be a transportable barrier that can be easily installed on a road upon demand and at the same ease, can be dismantle and transported to another location, it can be maintained in a certain site for some time while vehicles are passing over it due to its flat state and therefore, it should be designed to prevent inconvenience to vehicles that are allowed to pass it or in times it is not in active role. Therefore, an erectable barrier 500 made of barrier units 502 can be incorporated within a designated structure 504 shaped similarly to a speed bump wherein the barrier units 502 are embedded within the structure as well as the connecting rods 506, in this case. FIGS. 5*a* and 5*c* illustrates the embedded barrier units 502 within the structure 504. The structure 504 can be made of material such as shock absorbing surfaces like recycled plastic, rubber, vulcanized rubber, metallic materials, or composite materials as well. The barrier units 502 in erectable active states are shown in FIGS. 5*c* and 5*d* with the movable hurdle 505 in an upright position. The structure of the barrier units can be similar to the embodiments shown herein before or any other structure and erecting mechanisms can be utilized without limiting the scope of the disclosed subject matter.

It was mentioned that the barriers disclosed in this application are transportable in an easy manner. It should be noted that the barriers can also be transported using dedicated tooling such as wheels, carriages etc.

Figure 6A:
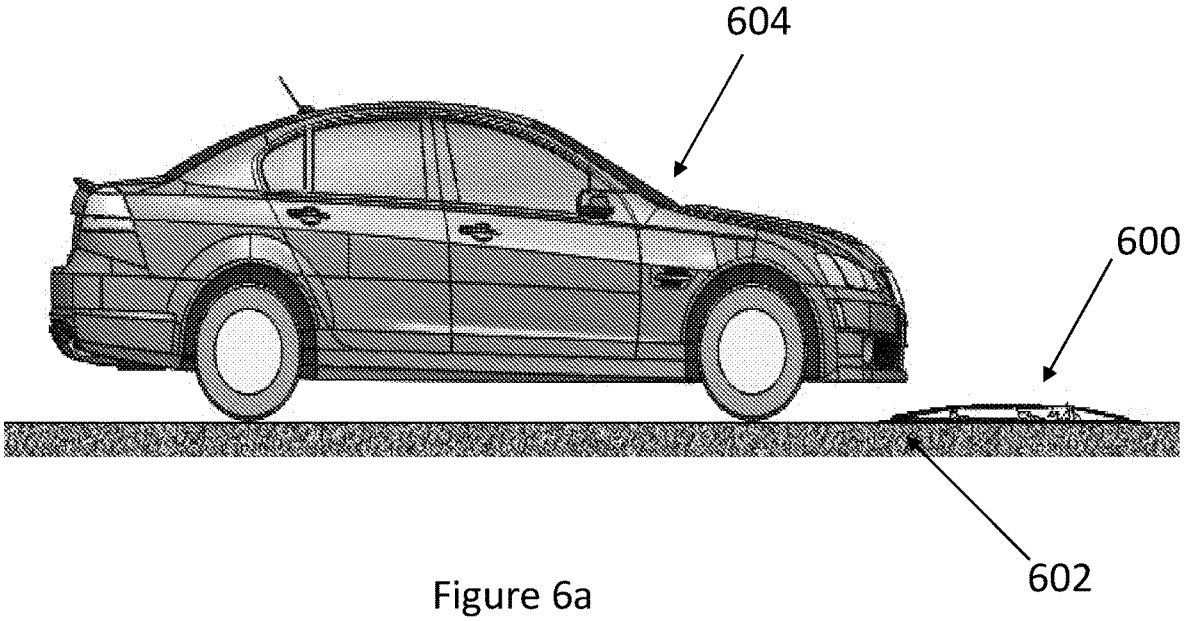
FIGS. 6*a-d* illustrate a vehicle passing over a barrier in accordance with some other exemplary embodiments of the disclosed subject matter and stopped by the barrier when in active position.
Figure 6B:
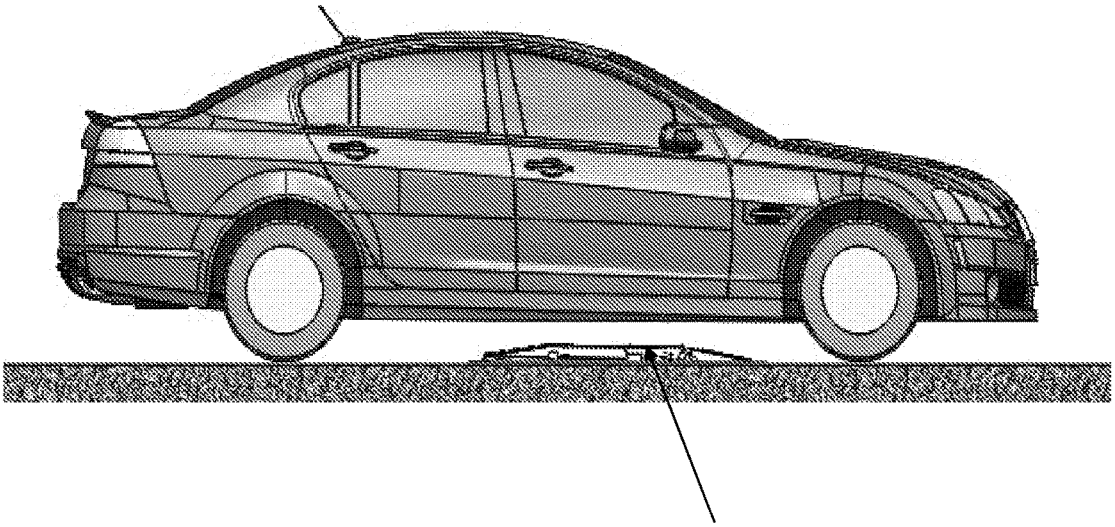
Figure 6C:
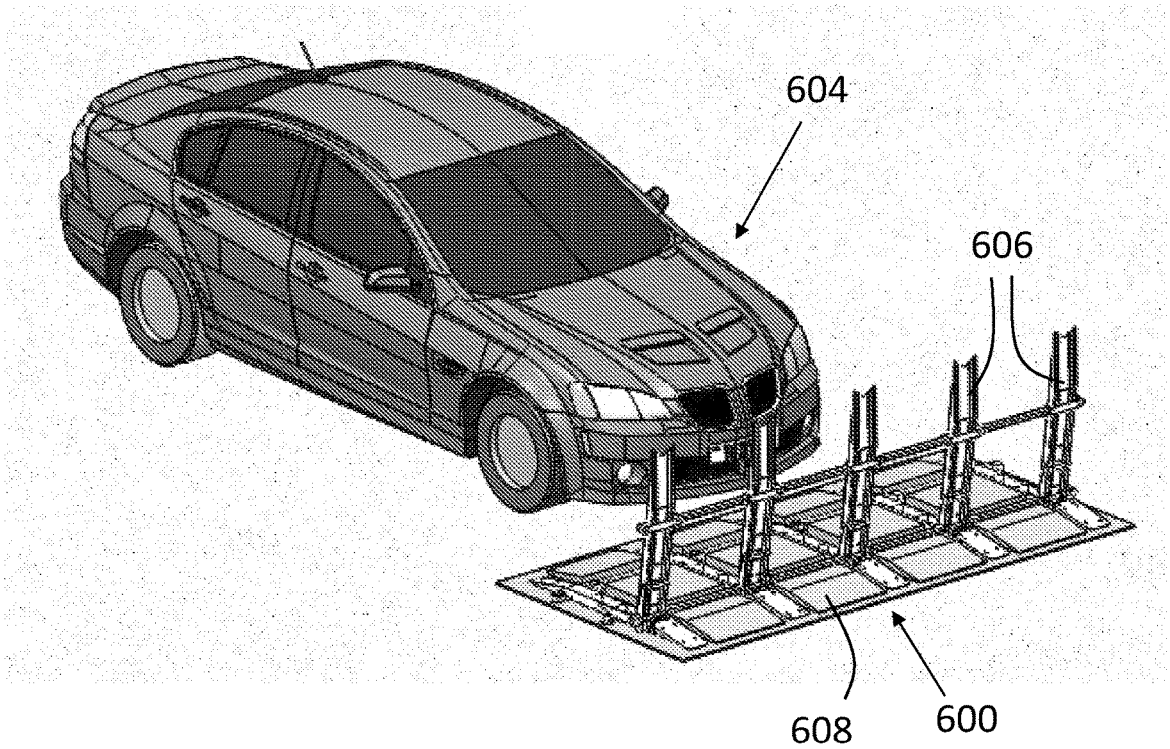
Figure 6D:
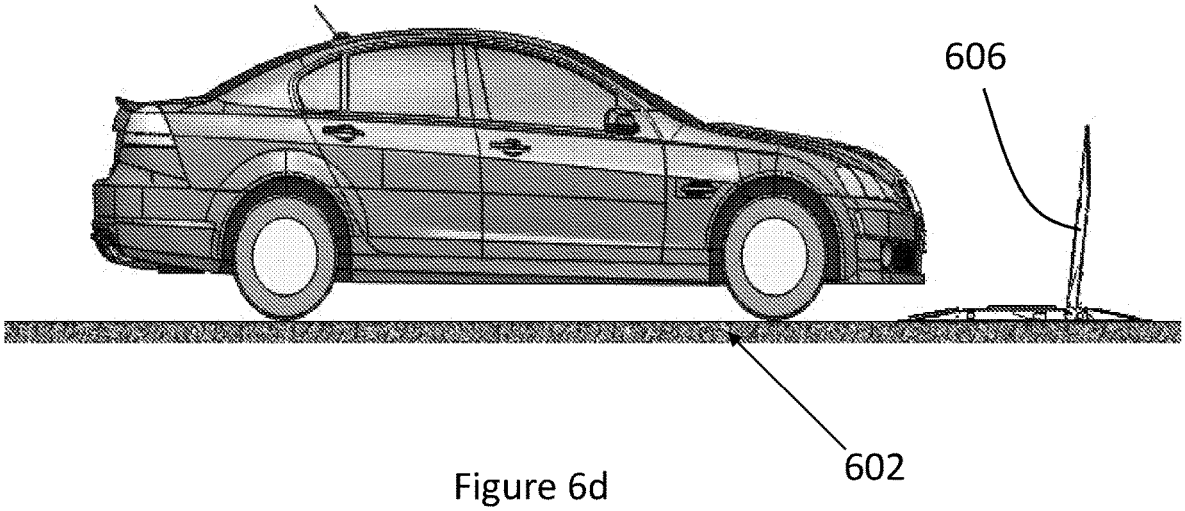

Reference is now made to FIGS. 6*a-d* illustrating a vehicle passing over a barrier in accordance with some other exemplary embodiments of the disclosed subject matter and stopped by the barrier when in active position. FIGS. 6*a* and 6*b* illustrate the erectable barrier 600 placed on a road 602 wherein a car 604 passes over it without any substantial disturbance and the barrier act as a speed bump. In FIGS. 6*c* and 6*d*, the erectable barrier 600 is shown to be in an erected active state in which the car 604 is prevented from passing through it. The hurdles 606 are in an uptight position, erected from within the structure 608.

It should be mentioned that even though the erectable barriers depicted herein above are defined as unidirectional, they can stop a vehicle that comes also from the opposite direction, however, this blockage will be relatively less efficient then the blockage made from the direction shown in FIGS. 6*a-d*.

Reference is now made to FIGS. 7*a-e* illustrating a bidirectional erectable barrier in a resting position and in an erectable active position in side and upper views, in accordance with some exemplary embodiments of the disclosed subject matter. The bidirectional erectable barrier 700 is shown in a resting position in FIGS. 7*a-b* in which the barrier is mounted on the road and has no significant impact on the traffic that may pass on the road. The erectable barrier 700 comprises a base structure 702 that comprises two parallel beams and two movable plates 707 that are supported on rods structure 704. On both sides of the plates, opposite the direction of possible vehicles, wedge-shaped extensions 706 are provided to enable vehicles to readily ascend and descend the barrier. An adjustment spring 709 is optionally provided within the extension so as to enable control over its height. The base 702 is provided with an extending flange 708 provided with holes that are adapted to allow pegs (not shown in the figures) to connect the barrier 700 to the road. The wedge-shaped extensions 706 may optionally be provided also with holes 710 through which pegs can be also affixed to the road.

Optionally, handles 705 that can be extended from the surface are provided in order to remove the barrier preferably by lifting it. As shown in the figures, the handles 705 are provided on the wedge-shaped extension, however, they can be placed in other positions of the barrier.

Supporting rods 704 are connected to each other substantially at the middle of the barrier by a hinge 712.

Figure 7A:
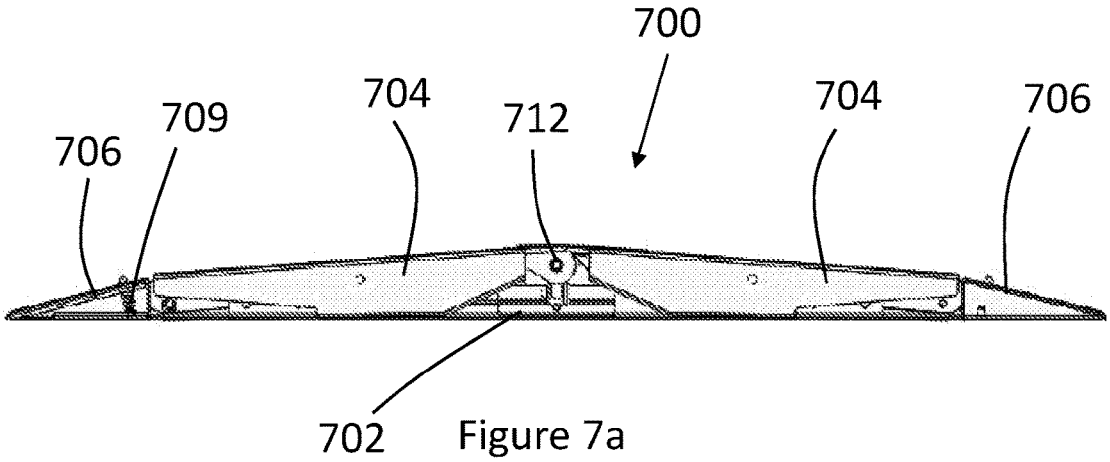
FIGS. 7*a-e* illustrate a bidirectional erectable barrier in a resting position and in an erectable position in side and upper views, in accordance with some exemplary embodiments of the disclosed subject matter.
Figure 7B:
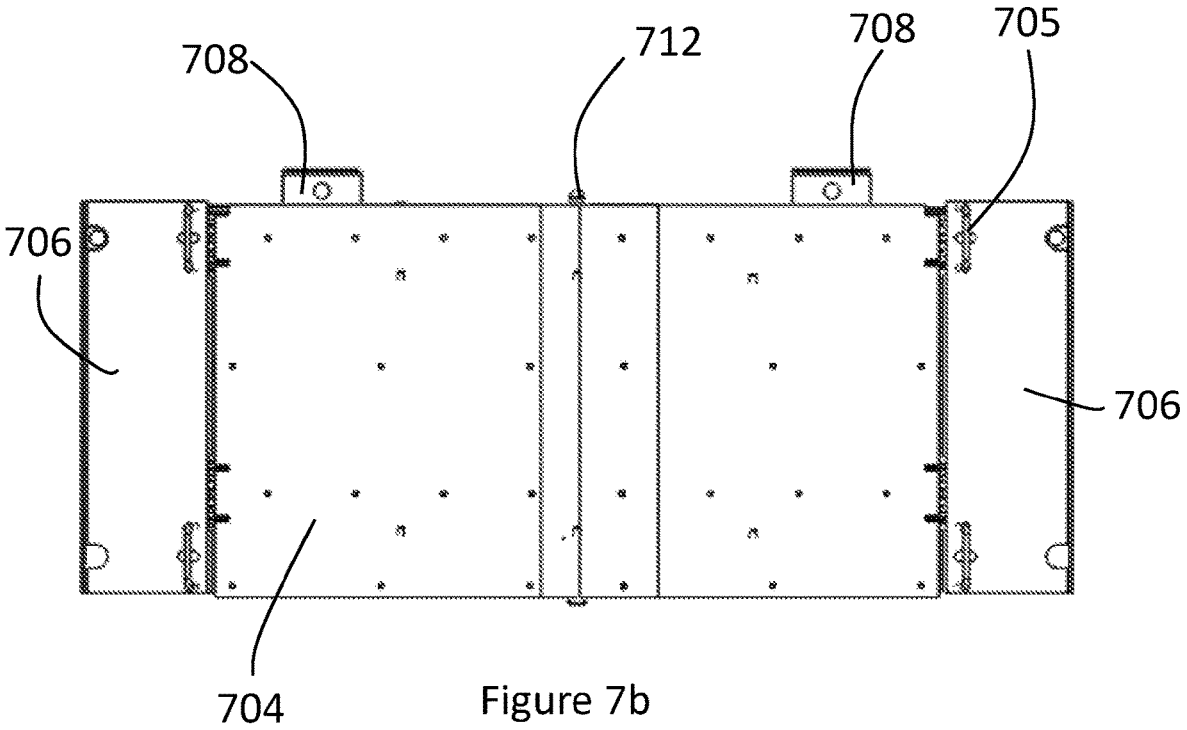
Figure 7C:
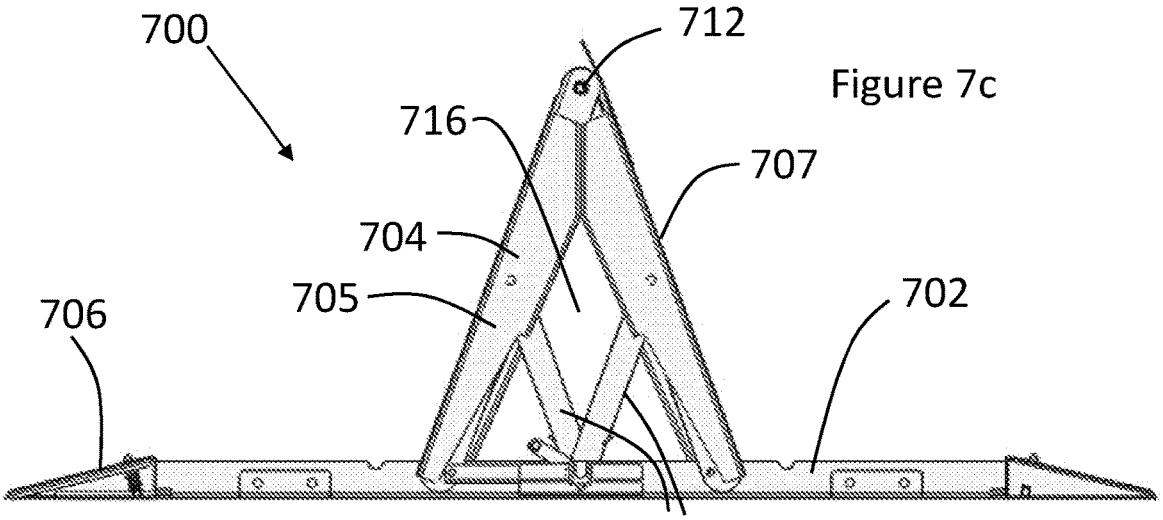
Figure 7D:
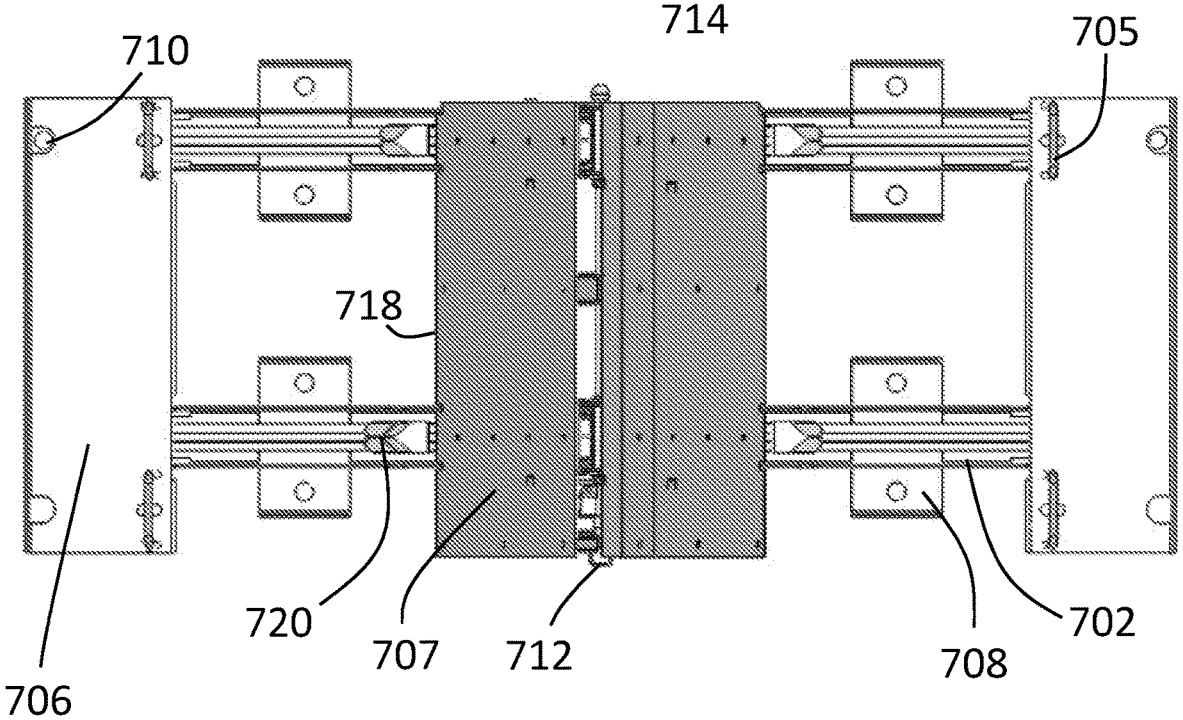
Figure 7E:
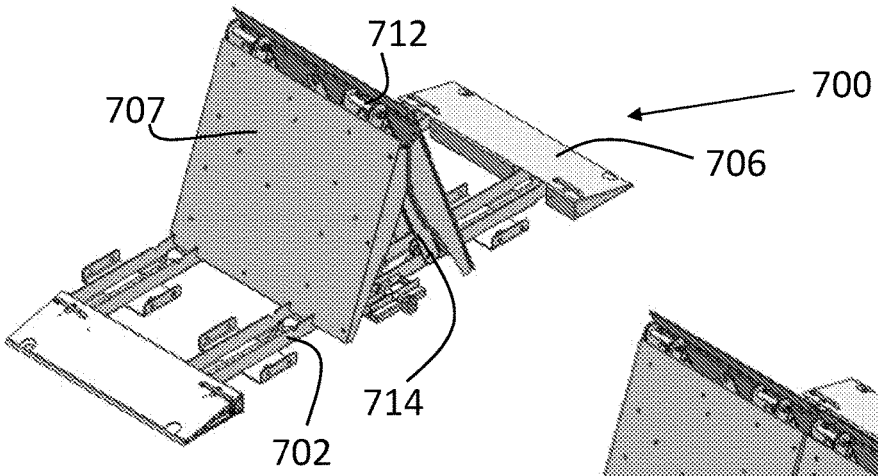

FIGS. 7*c-e* illustrates the bidirectional erectable barrier 700 in an erectable active position in which the plates 707 after moved one towards the other, are organized in a pyramid shape at the center of the barrier 700. While the plates 707 using the supporting rods 704 are moving one towards the other, they rotate about the hinge 712 that has now moved distantly from the base 702. The plates while erected are opposite each other facing opposite sides of the road. Vehicles that are coming from either side of the barrier are encountered with a corresponding plate that is positioned opposite the vehicle directions. In order to allow smooth movement of the vehicle on the barrier when it is in resting state, one of the plates is longer than the other as can be seen in FIG. 7*c*.

Beneath the supporting rods and the plates, fastening shafts 714 are provided (best seen in FIG. 7*c* that is a side view of the barrier in the erecting position). When the supporting rods 704 are erected from the resting position to the active position, the fastening shafts 714 are also erecting, to form a rhombus structure 716 that renders the erected plates 707 when in an erecting position extra strength so as to prevent possible collapse of the plates and their supporting rods in case a vehicles bumps into them from one of the sides. The fastening shafts 714 can be moved beneath the plates using wheels (not shown in the figures).

Optionally and best seen in FIG. 7*d*, the base 702 onto which the lower edges 718 of the plates 707 slides are provided with sweepers 720 that are capable of being moved on the parallel beams of the base 702 similar to a rail in order to sweep dirt or snow that may accumulate on the base when the barrier was at rest and may disturb the erection of the plates upon need.

It should be mentioned that the erection function of the plates can be performed manually or automatically using any available mechanism. As an example, a default spring mechanism similar the one that was already described herein before can be employed also here.

Figure 8B:
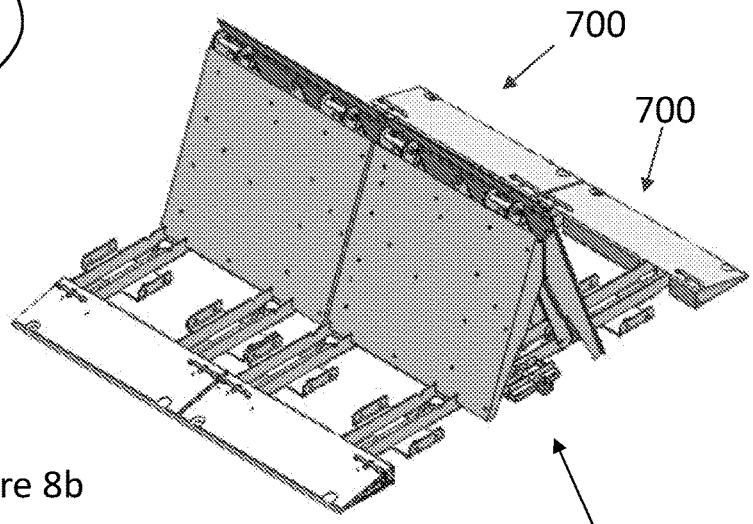
FIGS. 8*a-b* illustrate two bidirectional erectable barriers units as shown in FIGS. 7*a-e* in a series and in the two positions.
Figure 8A:
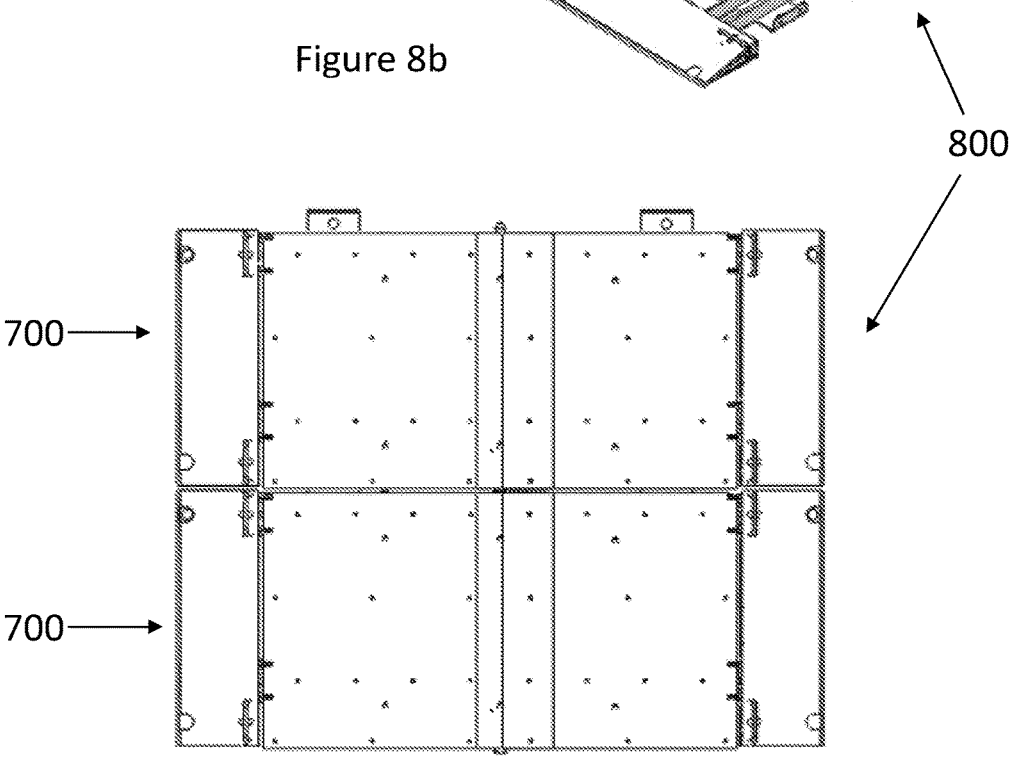

Reference is now made to FIGS. 8*a-b* illustrating two bidirectional erectable barriers units as shown in FIGS. 7*a-e* in a series and in the two positions. Erectable barrier 800 comprises two units of erectable barriers 700 so as to establish an elongated barrier that can block an entire road. As indicated previously, the bidirectional barrier is aimed at preventing vehicles to pass through the barrier from both sides of the road and therefore it is needed to be placed along a road that can be relatively broad. A plurality of barriers as disclosed herein in FIGS. 7*a-e* can be employed in order to form an elongated barrier.

In the embodiments that will be described herein after, a wording blade is used as synonym to a hurdle and chassis is used as synonym word for the base.

Figure 9:
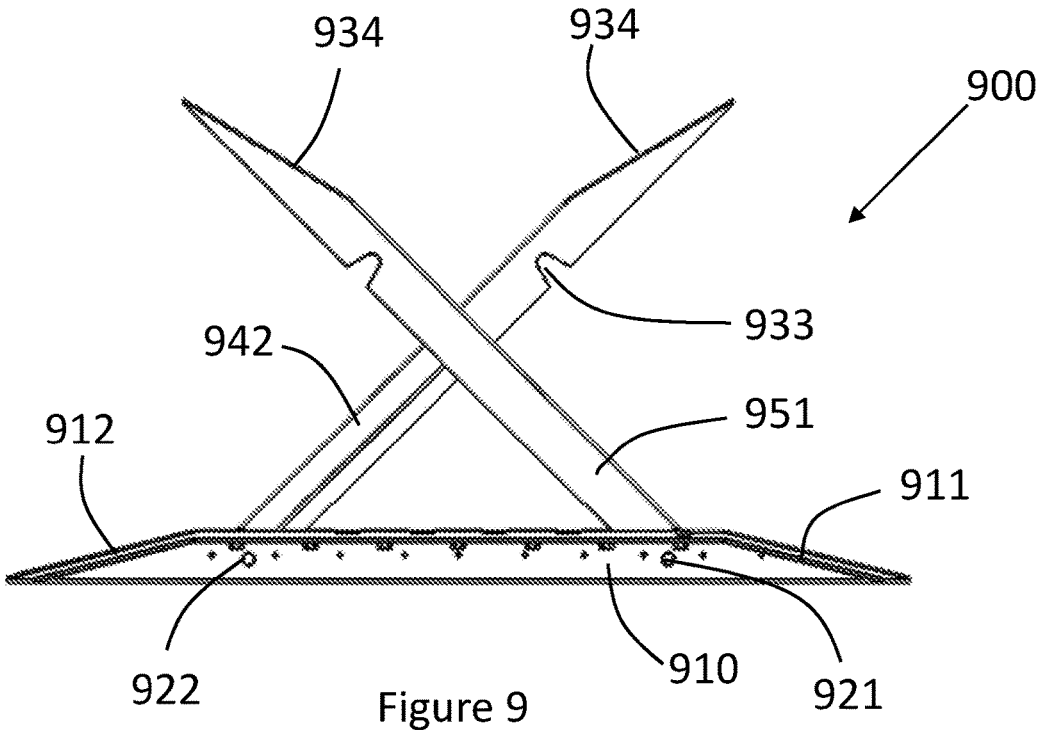
FIG. 9 illustrates a side view of a bidirectional scissors barricade in erect position, in accordance with some exemplary embodiments of the disclosed subject matter.

Reference is now made to FIG. 9 illustrating a side view of a bidirectional scissors barricade 900, in erect position, in accordance with some exemplary embodiments of the disclosed subject matter. The bidirectional scissors barricade 900 apparatus may be constructed of chassis 910, at least one blade 951, at least second blade 942, corresponding hinges 922 and hinge 921 and an erection mechanism (not shown, but similar to an erection mechanism shown herein before).

In some exemplary embodiments, chassis 910 may be made of material such as shock absorbing surfaces like recycled plastic, rubber, vulcanized rubber, metallic materials, composite materials, fiberglass, a combination thereof, or the like. The chassis 910 may be used to accommodate the at least one blade 951 and the at least second blade 942, which are connected to chassis 910 by hinge 921 and hinge 922 respectively. In some exemplary embodiments, the at least one blade 951 and the at least second blade 942 may be identical in shape, fit and form, where each of which have a cutout 933 needed to enable recessing the blades inside chassis 910.

In some exemplary embodiments, each blade may be made of a metal beam, having a C-shaped cross section, comprising two flanges connected by a web, however the beam may be one solid piece. The C-shaped beam are generally steel, aluminum or stainless steel, manufactured in a method of hot rolling, extrusion, a combination thereof, or the like.

In some exemplary embodiments, both flanges of each blade have a hole, located substantially at one end of the blade, wherein the holes on both flanges are parallel. It will be noted that the holes are adapted to allow a hinge to connect the blades to the chassis 910 by insertion of the hinges (921, 922) across the chassis and through the blades. Thus, enabling rotation of the blades about the hinges. Additionally, the other end of each blade may have a profile shaped as a right triangle, wherein the hypotenuse of the right triangle is slope 934. Since FIG. 9 depicts a side view of the blades, it should be noted that slope 934 may be a continuation of the C-shaped beam web. (better depicted in FIG. 11, described below).

In some exemplary embodiments, the erection mechanism is configured to propel the bidirectional scissors barricade 900 between resting position to erect position and vice versa. The erect position is the position in which the at least one blade 951 and the at least second blade 942 protrude above the chassis at an angle that may vary between 30 to 60 degrees with respect to the chassis. The erection mechanism may be accommodated within chassis 910 and may be operated manually or automatically using mechanism, such springs, pneumatic system, hydraulic system, crank operated winch, electrical system, a combination thereof, or the like.

Figure 10A:
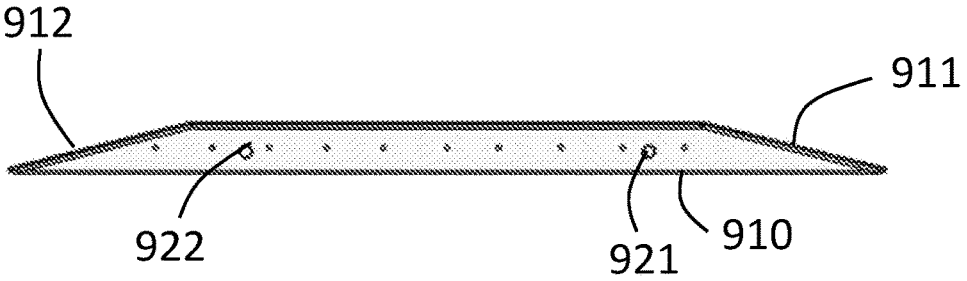
FIGS. 10*a* and 10*b* illustrate a side view and top view, respectively, of a bidirectional scissors barricade in resting position, in accordance with some exemplary embodiments of the disclosed subject matter.
Figure 10B:
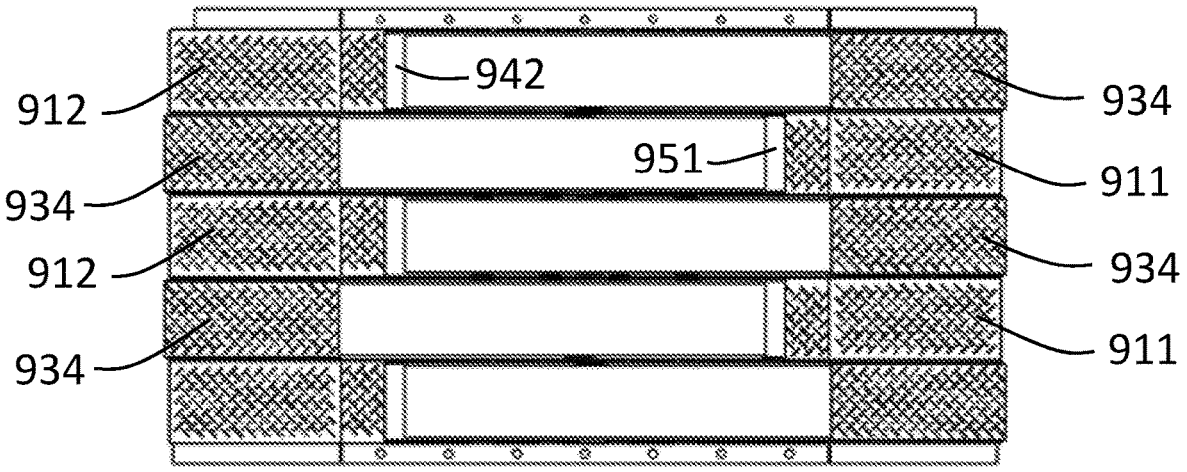

Reference is now made to FIGS. 10*a* and 10*b* illustrating a side view and top view, respectively, of a bidirectional scissors barricade in resting position, in accordance with some exemplary embodiments of the disclosed subject matter. The resting position is the position in which the blade 951 and the second blade 942 are recessed inside the chassis and together form a flat surface that is parallel to the road that the chassis resides on. In some exemplary embodiments, slopes 911 and 912 as well as slops 934 of blade 951 and blade 942, may have rugged surface for increasing the friction between vehicles wheels and the barricade while in resting position.

In some exemplary embodiments, the blades of the bidirectional scissors barricade 900 may be assembled to chassis 910 while barricade 900 is in resting position. The blades may each be placed into a compartment (shown in FIG. 11) of chassis 910 in alternating order, so that slops 934 of blades 951 aligns with slopes 912 on one side of barricade 900 and slops 934 of blades 942 aligns with slopes 911 on the other side of barricade 900. Following the placement of the blades, hinge 922 may be inserted to connect blades 942 to the chassis and hinge 921 may be inserted to connect blades 951 to the chassis.

Figure 11:
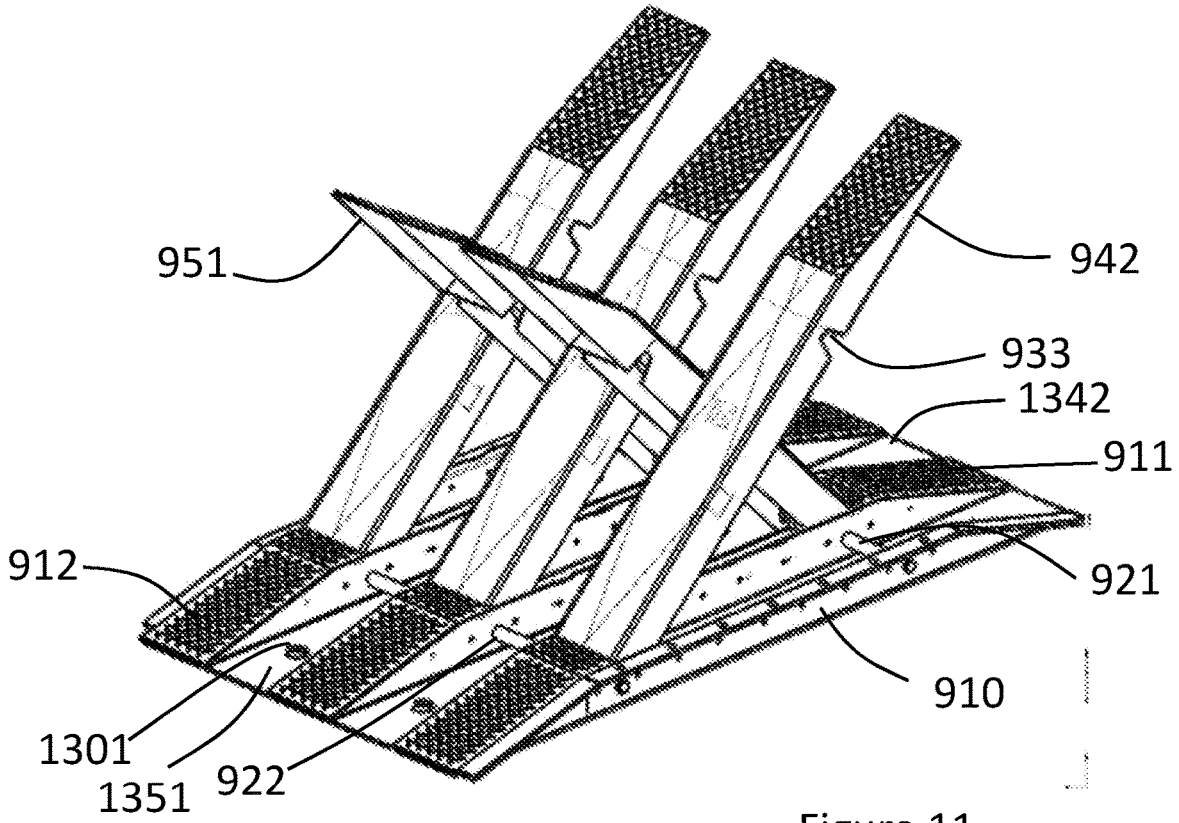
FIG. 11 illustrates a perspective view of a bidirectional scissors barricade in erect position, in accordance with some exemplary embodiments of the disclosed subject matter.

Referring now to FIG. 11 illustrating a perspective view of a bidirectional scissors barricade, in erect position, in accordance with some exemplary embodiments of the disclosed subject matter. The structure of chassis 910 is best depicted in FIG. 11, also showing compartments 1351 and 1342 as well as mounting holes 1301. As previously mentioned, the compartments are configured to accommodate the blades in a resting position, wherein compartments 1351 and 1342 accommodate blades 951 and 942 respectively. It should be noted that cutout 933 of both blades 951 and 942 are required to clear hinges 922 and 921 respectively.

In some exemplary embodiments, the bottom of chassis 910 can be provided with grippers (not shown) adapted to grasp the surface of the road to prevent its movement when vehicles pass over the bidirectional scissors barricade 900. Additionally, or alternatively, the mounting holes 1301 can allow for bolting or nailing the barricade 900 to the road. Anchoring the barricade to the road can be performed in various methods as mentioned herein before or can be attached to an existing foundation in the road that is pre-prepared.

The bidirectional scissors barricade is intended for preventing vehicles to pass through the barricade from both sides of the road and therefore it is needed to be placed along a road that can be relatively broad. Hostile vehicles coming from either side of the barricade are encountered with corresponding blades positioned opposite the vehicle.

Figure 12:
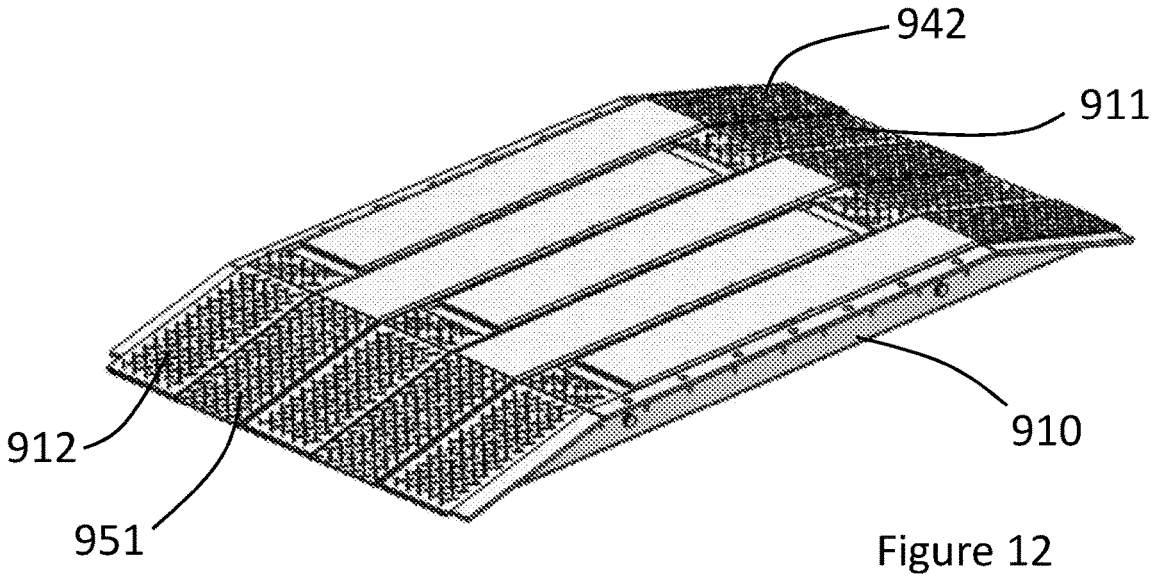
FIG. 12 illustrates a perspective view of a bidirectional scissors barricade in resting position, in accordance with some exemplary embodiments of the disclosed subject matter.

Reference is now made to FIG. 12 illustrating a perspective view of a bidirectional scissors barricade, in resting position, in accordance with some exemplary embodiments of the disclosed subject matter. In the example depicted in FIG. 12, blades 942 and 951 are retracted into their corresponding compartment to form the resting position. In such embodiments slopes 934 of blades 951 together with slopes 912 form a stretched slop across one side of barricade 900 and slopes 934 of blades 942 together with slopes 911 form a stretched slop across the other side of barricade 900.

It will be noted that the bidirectional scissors barricade 900 is designed to allow vehicles passing on it when the barricade is in resting position. Both sides of the barricade 900 are provided with slopes and a flat surface between them, so that wheels of vehicles can pass through the resting barricade with minimal disturbance, however slowing the vehicles for monitoring.

Figure 13:
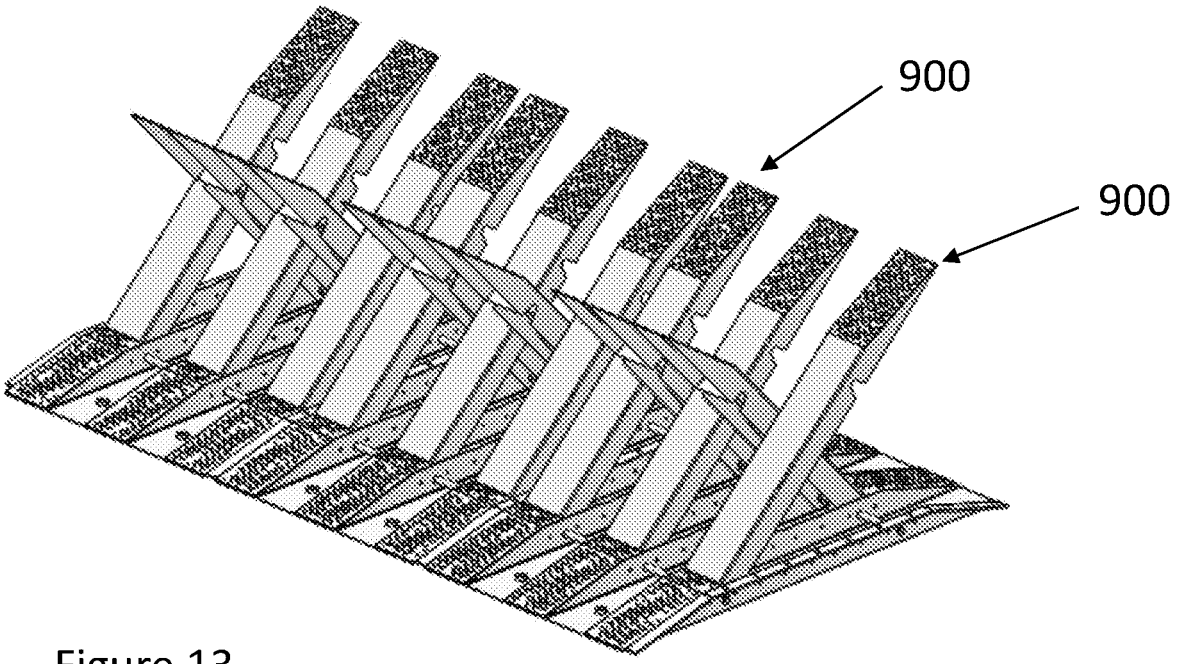
FIG. 13 illustrates a perspective view of a plurality of bidirectional scissors barricade in erect position, in accordance with some exemplary embodiments of the disclosed subject matter.

Referring now to FIG. 13 illustrating a perspective view of a plurality of bidirectional scissors barricade 900 in erect position, in accordance with some exemplary embodiments of the disclosed subject matter. It should be noticed that the erectable barricade 900 can be aligned on the road and be left on site for a period of time it is needed. Then, the barricade can be taken to another site. One of the advantages of forming a roadblock from a plurality of barricade 900 is that the units are independent of each other and therefore, some of them can be placed (for example) in an erect position while the others are in resting position, all per need.

Figure 14:
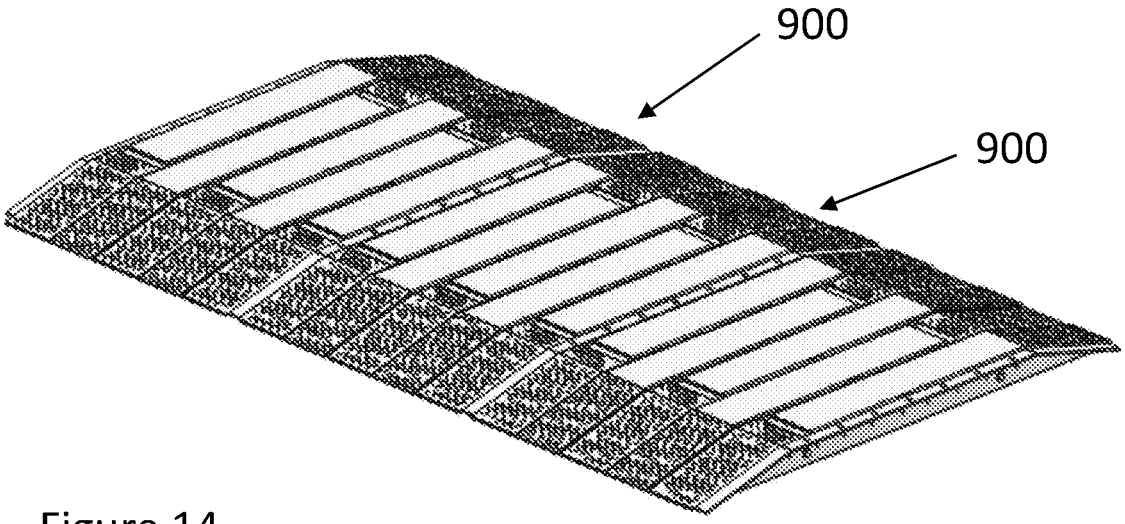
FIG. 14 illustrates a perspective view of a plurality of bidirectional scissors barricade in resting position, in accordance with some exemplary embodiments of the disclosed subject matter.

Referring now to FIG. 14 illustrating a perspective view of a plurality of bidirectional scissors barricade in resting position, in accordance with some exemplary embodiments of the disclosed subject matter. It will be noted that the bidirectional scissors barricade 900 is designed to prevent inconvenience to vehicles that are passing it, in times that the barricade 900 is not in active role. It will also be noted that the barricade 900 is designed to be transportable while in resting position. Also, the barricade 900 can be easily deployed on a road upon demand or dismantle and transported to another location.

In some exemplary embodiments, activating the erection mechanism of barricade 900 to retract the blades to resting position or to extract the blades to erect position, can be done from remote location. To do so, the erection mechanism may be equipped with a device configured to receive radio signals transmitted by dedicated transmitter or a cell phone, for example.

Figure 15A:
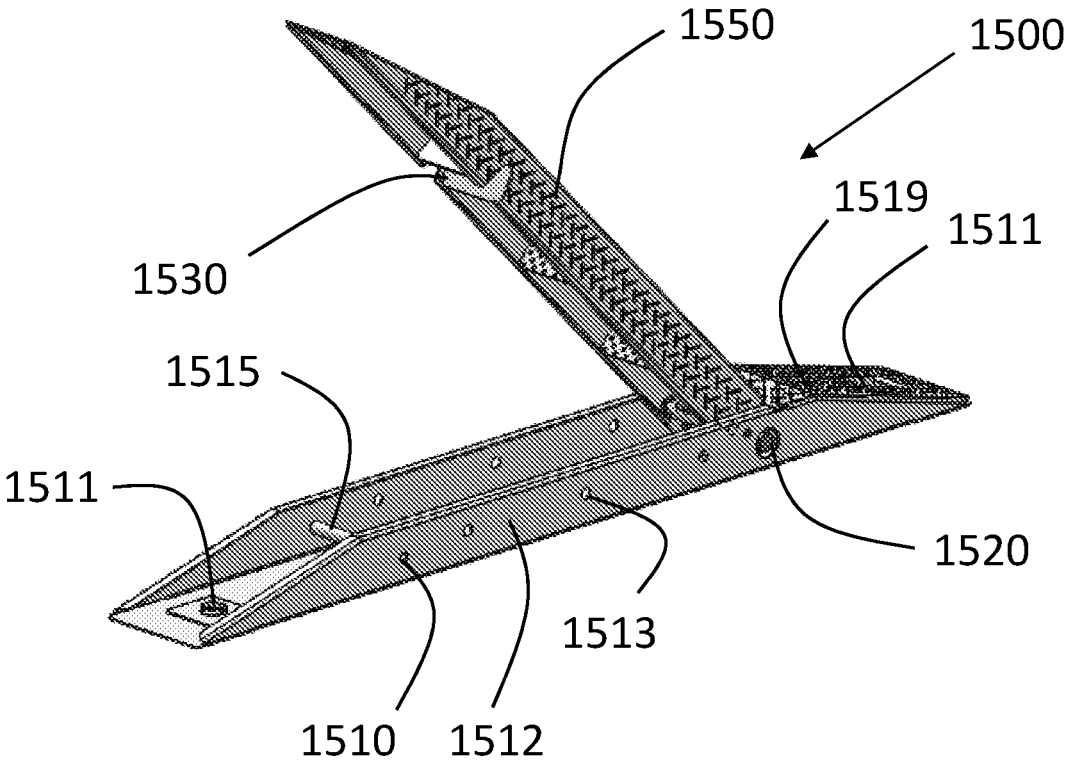
FIGS. 15*a* and 15*b* illustrate a perspective view of a barricade modules, in erect position and resting position respectively, in accordance with some exemplary embodiments of the disclosed subject matter.
Figure 15B:
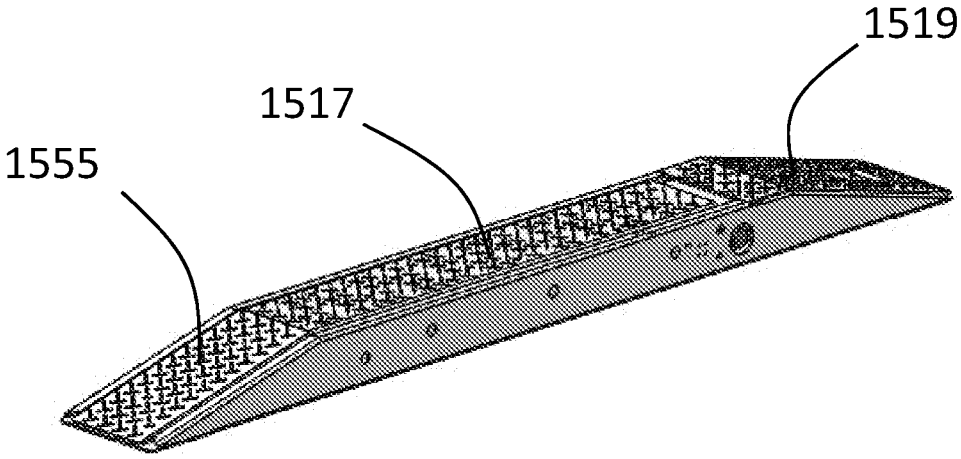

Referring now to FIGS. 15*a* and 15*b* illustrating a perspective view of a barricade module 1500, in erect position and resting position, respectively, in accordance with some exemplary embodiments of the disclosed subject matter. The barricade module 1500 may be constructed of chassis 1510, a blade 1550, a hinge 1520 and an erection or default mechanism (not shown).

In some exemplary embodiments, chassis 1510 may be made of material such as shock absorbing surfaces like recycled plastic, rubber, vulcanized rubber, metallic materials, composite materials, a combination thereof, or the like. The chassis 1510 may comprise two identical flanges 1512, parallelly facing each other, used to accommodate the at least one blade 1550, which is connected to chassis 1510 by hinge 1520. In some exemplary embodiments, chassis 1510 also comprise a sleeve 1515 for enforcing the chassis and maintain constant space between flanges 1512. The side, closer to hinge 1520, of the chassis may be ended with a slope 1511, which has rugged surface to increase friction between vehicles wheels and the barricade, while in resting position.

Additionally or alternatively, chassis 1510 may have a plurality of holes 1513, on both flanges, which allow bolting a plurality of barricade modules 1500 together. In some exemplary embodiments, chassis 1510 may also comprise mounting holes 1511, on both ends of the chassis, utilized for bolting, or nailing the barricade 1500 down to a surface; such as a road, or a driveway; in which the barricade module 1500 may be needed.

In some exemplary embodiments, the at least one blade 1550 may have a cutout 1530 needed to clear sleeve 1515 so that blade 1550 may be recessed inside chassis 1510, when in resting position. In some exemplary embodiments, blade 1550 may be made of a metal beam, having a C-shaped cross section, comprising two flanges connected by a web 1517, however the beam may be one solid piece. The C-shaped beam are generally steel, aluminum or stainless steel, manufactured in a method of hot rolling, extrusion, a combination thereof, or the like.

In some exemplary embodiments, both flanges of each blade have a hole, located substantially at one end of the blade, wherein the holes on both flanges are parallel. It will be noted that the holes are adapted to allow hinge 1520 to connect the blades to the chassis 1510 by insertion of the hinge 1520 across the chassis and through the blades. Thus, enabling rotation of the blades about the hinges. Additionally, the other free end of each blade may have a profile shaped as a right triangle, wherein the hypotenuse of the right triangle is slope 1555 (FIG. 15*b*). It should be noted that slope 1555 may be a continuation of the C-shaped beam web 1517 and both (slope 1555 plus web 1517) have rugged surface for increasing the friction between vehicles wheels and the barricade while in resting position.

In some exemplary embodiments, the erection mechanism is configured to propel the barricade module 1500 between resting position to erect position and vice versa. The erect position is the position in which blade 1550 protrude above the chassis (as depicted in FIG. 15*a*) at an angle that may vary between 30 to 60 degrees with respect to the chassis. The erection mechanism may be accommodated within chassis 1510 and may be operated manually or automatically using mechanism, such springs, pneumatic system, hydraulic system, crank operated winch, electrical system, a combination thereof, or the like.

Figure 16A:
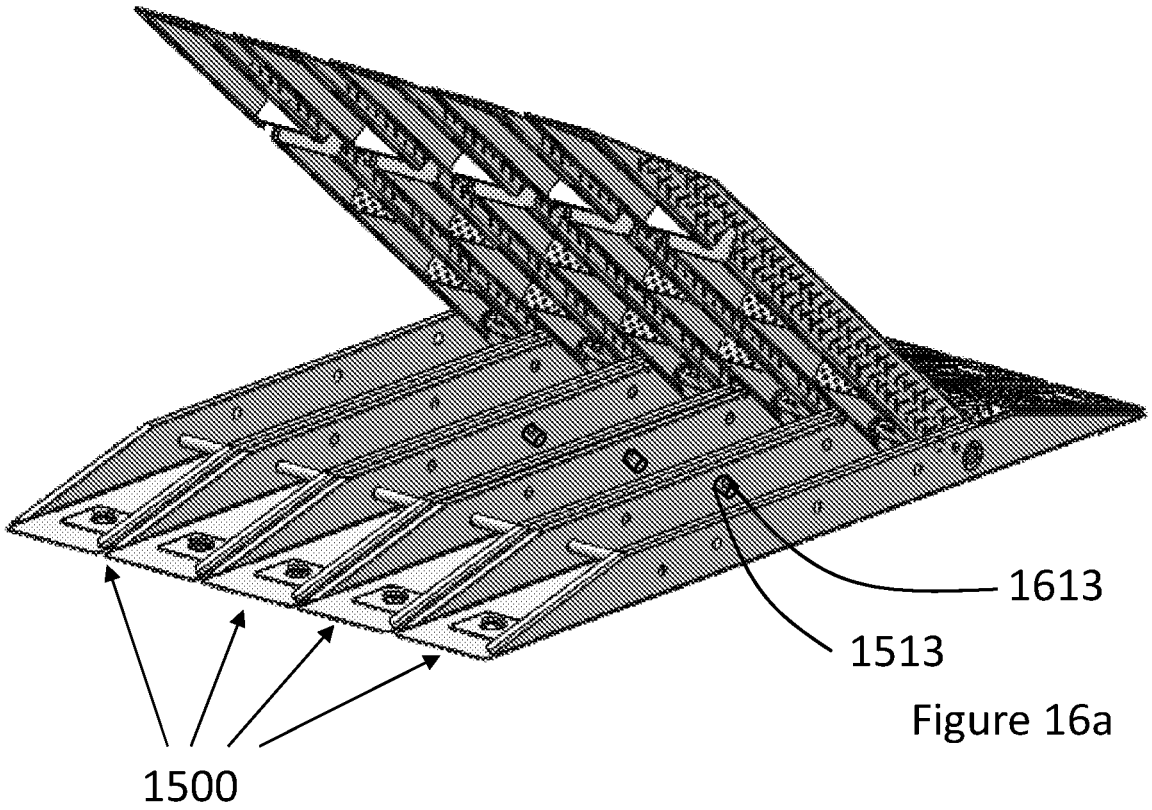
FIGS. 16*a* and 16*b* illustrate a perspective view of a plurality of barricade modules, in erect position and resting position respectively, in accordance with some exemplary embodiments of the disclosed subject matter.
Figure 16B:
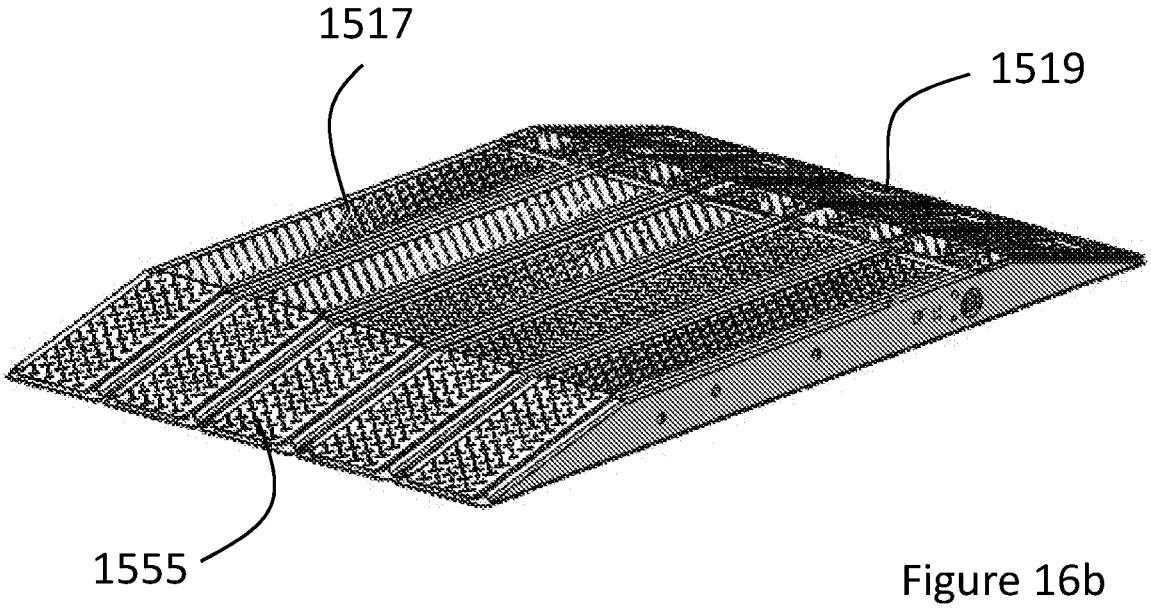

Referring now to FIGS. 16*a* and 16*b* illustrating a perspective view of a plurality of barricade modules 1500, in erect position and resting position respectively, in accordance with some exemplary embodiments of the disclosed subject matter.

In some exemplary embodiments, a plurality of bolts 1613 (only some of the bolts are shown for clarity reasons) may be used to assemble a plurality of barricade modules 1500 together by screwing bolts 1613 into holes 1513 of two adjacent modules 1500, as depicted in FIG. 18*a*. In one exemplary embodiment, the plurality of barricade modules is aligned one next to the other in a way that every other module faces opposite direction. Meaning, that blades 1550 of every other module erect to opposite direction. Thus, the plurality of barricade modules 1500 are configured as a bidirectional barricade for blocking traffic in both directions of the roadblock, just like the bidirectional scissors barricade 900 described above. In other exemplary embodiments, the plurality of barricade modules is aligned one next to the other in a way that all the module face the same direction (such as the example depicted in FIG. 16*a*) and thus, configured as a unidirectional barricade.

The resting position is the position in which the blades 1550 of the plurality of barricade modules 1500 are recessed inside their chassis and together form a surface comprised of a plurality of webs 1517 of the plurality of modules 1500. Each side of that surface have a slope comprised of slopes 1555 and slopes 1519 of the plurality of modules 1500. Thus, the plurality of barricade modules 1500 assembled together form an elongated barricade that can be utilized as a roadblock, additionally, the elongated barricade may be secured to the road by driving bolts, stakes, nails a combination thereof, or the like. through mounting holes 1511 of each module 1500.

In some exemplary embodiments, slopes 1555, slopes 1519 and webs 1517 have rugged surface for increasing the friction between vehicles wheels and the barricade while in resting position. Also, the bottom of chassis 1510 can be provided with grippers (not shown) adapted to grasp the surface of the road to prevent its movement when vehicles pass over the elongated barricade.

It will be noted that the elongated barricade is designed to allow vehicles passing on it when the barricade is in resting position. Both sides of the elongated barricade are provided with slopes and a flat surface between them, so that wheels of vehicles can pass through the resting barricade with minimal disturbance, however slowing the vehicles for monitoring. In the resting position, depicted in FIG. 16*b*, all the blades are retracted into their chassis, and slopes 1555 form a stretched slope across one side of the elongated barricade while slopes 1519 form a stretched slop across the other side of the elongated barricade.

It should be that that the elongated barricade can be aligned on the road and be left on site for a period it is needed. Then, the barricade can be taken to another site. One of the advantages of forming a roadblock from a plurality of barricade modules 1500 is that the modules are independent of one other and therefore, some of them can be placed (for example) in an erect position while the others are in resting position, all per need. Moreover, part of the barricade can be arranged to be unidirectional and part of it can be arranged to be bidirectional. Also, all the barricade can be arranged to be unidirectional or bidirectional while this is a modular feature that is unique to this type of barrier.

In some exemplary embodiments, activating the erection mechanism of the barricade modules 1500, to retract the blades to resting position or to extract the blades to erect position, can be done from remote location, as mentioned herein before.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. An erectable barrier unit comprising:

a base;

at least one movable hurdle connected to the base wherein the movable hurdle can move between a resting position in which the hurdle is adjacent to the base and an erected position in which a predetermined angle is formed between the hurdle and the base, wherein the at least one movable hurdle comprises at least two supporting rods that are moving one towards the other and wherein the at least two supporting rods are connected by a hinge positioned between them so that as the rods are moving towards each other, the hinge is moving away from the base, wherein the erectable barrier unit further comprises fastening shafts connected between the base and the supporting rods wherein when the supporting rods are erected, the supporting rods and the fastening shafts form a rhombus structure that provides additional strength to the barrier unit.

2. The erectable barrier unit as claimed in claim 1, wherein the erected position is a default position.

3. The erectable barrier unit as claimed in claim 2, wherein the erectable barrier unit is further provided with a default mechanism between the hurdle and the base, and wherein the default mechanism comprises a spring and a corresponding axis that assures the hurdle is instantly moving to the erected position.

4. The erectable barrier unit as claimed in claim 1, wherein a fastener is provided between the hurdle and the base so as to assure they are fully adjacent in the resting position.

5. The erectable barrier unit as claimed in claim 1, wherein the base is provided at at least one of its ends with an extension and wherein the extension is shaped as a wedge.

6. The erectable barrier unit as claimed in claim 1, wherein a free end of the hurdle is wedge shaped.

7. The erectable barrier unit as claimed in claim 1, wherein, in the resting position, the barrier unit is flat.

8. The erectable barrier unit as claimed in claim 1, wherein the predetermined angle is more than 90 degrees.

9. The erectable barrier unit as claimed in claim 1, wherein the base is provided with holes through which it can be fixed to a road.

10. The erectable barrier unit as claimed in claim 1, wherein the at least one hurdle and the base are provided with connecting protrusions that are configured to receive connecting rods that can connect a plurality of similar barrier units having a plurality of bases and movable hurdles aligned to each other so as to form a barricade.

11. The erectable barrier unit as claimed in claim 1, wherein at least two plates are connected onto the supporting rods so that in the erecting position, the plates are opposite each other so as to form a bidirectional barrier.

12. An erectable barrier unit comprising:

a base;

at least one movable hurdle connected to the base wherein the movable hurdle can move between a resting position in which the hurdle is adjacent to the base and an erected position in which a predetermined angle is formed between the hurdle and the base, wherein the at least one movable hurdle comprises at least two supporting rods that are moving one towards the other and wherein the at least two supporting rods are connected by a hinge positioned between them so that as the rods are moving towards each other, the hinge is moving away from the base and wherein the base comprises two parallel beams onto which the supporting rods can slide.

13. The erectable barrier unit as claimed in claim 12, wherein the erected position is a default position.

14. The erectable barrier unit as claimed in claim 13, wherein the erectable barrier unit is further provided with a default mechanism between the hurdle and the base, and wherein the default mechanism comprises a spring and a corresponding axis that assures the hurdle is instantly moving to the erected position.

15. The erectable barrier unit as claimed in claim 12, wherein a fastener is provided between the hurdle and the base so as to assure they are fully adjacent in the resting position.

16. The erectable barrier unit as claimed in claim 12, wherein the base is provided at at least one of its ends with an extension and wherein the extension is shaped as a wedge.

17. The erectable barrier unit as claimed in claim 12, wherein a free end of the hurdle is wedge shaped.

18. The erectable barrier unit as claimed in claim 12, wherein in the resting position, the barrier unit is flat.

19. The erectable barrier unit as claimed in claim 12, wherein the predetermined angle is more than 90 degrees.

20. The erectable barrier unit as claimed in claim 12, wherein the base is provided with holes through which it can be fixed to a road.

21. The erectable barrier unit as claimed in claim 12, wherein the at least one hurdle and the base are provided with connecting protrusions that are configures to receive connecting rods that can connect a plurality of similar barrier units having a plurality of bases and movable hurdles aligned to each other so as to form a barricade.

22. The erectable barrier unit as claimed in claim 12, wherein at least two plates are connected onto the supporting rods so that in the erecting position, the plates are opposite each other so as to form a bidirectional barrier.

* * * * *